US011156937B2

(12) United States Patent
Nakase

(10) Patent No.: US 11,156,937 B2
(45) Date of Patent: Oct. 26, 2021

(54) IMAGE FORMING APPARATUS

(71) Applicant: CANON KABUSHIKI KAISHA, Tokyo (JP)

(72) Inventor: Takahiro Nakase, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/892,536

(22) Filed: Jun. 4, 2020

(65) Prior Publication Data

US 2020/0387083 A1 Dec. 10, 2020

(30) Foreign Application Priority Data

Jun. 7, 2019 (JP) ..... JP2019-107293

(51) Int. Cl.
*G03G 15/08* (2006.01)
*G03G 15/00* (2006.01)

(52) U.S. Cl.
CPC ..... *G03G 15/0856* (2013.01); *G03G 15/5016* (2013.01); *G03G 15/553* (2013.01)

(58) Field of Classification Search
CPC ..... G03G 15/0856; G03G 15/5016; G03G 15/553
See application file for complete search history.

(56) References Cited

U.S. PATENT DOCUMENTS 7,711,274 B2 5/2010 Zaima
9,274,482 B2 3/2016 Nakase et al.
10,018,951 B2 7/2018 Saito et al.
2013/0028617 A1* 1/2013 Fukuoka ..... G03G 15/502 399/27
2017/0315487 A1* 11/2017 Tomino ..... G03G 15/0844
2019/0354051 A1* 11/2019 Ogino ..... G06F 3/1235
2020/0387082 A1 12/2020 Nakase

FOREIGN PATENT DOCUMENTS

JP 2004-361752 A 12/2004
JP 2006-292830 A 10/2006
JP 2013-061880 A 4/2013
JP 2017-181964 A 10/2017
JP 2017-191234 A 10/2017

* cited by examiner

*Primary Examiner* — Joseph S Wong
(74) *Attorney, Agent, or Firm* — Venable LLP

(57) ABSTRACT

An image forming apparatus includes an image bearing member, a developing cartridge, a control portion configured to cause the image forming unit to form the toner image in one mode selected from a plurality of modes including a first image forming mode for forming a first toner image whose maximum loading amount is a first loading amount and a second image forming mode for forming a second toner image whose maximum loading amount is a second loading amount different from the first loading amount, a detection unit, and a display portion configured to display information related to the number of sheets of a recording material on which the first toner images can be formed in the first image forming mode and information related to the number of sheets of a recording material on which the second toner images can be formed in the second image forming mode.

16 Claims, 16 Drawing Sheets

FIG.10

REMAINING AMOUNT 20%

| | NORMAL MODE | CONCENTRATION-UP MODE |
|---|---|---|
| PREDICTED NUMBER OF USABLE SHEETS | 30,000 SHEETS | 2,500 SHEETS |
| NUMBER OF USED SHEETS | 24,000 SHEETS | 2,000 SHEETS |
| PREDICTED NUMBER OF REMAINING USABLE SHEETS | 6,000 SHEETS | 500 SHEETS |

FIG.11A

CARTRIDGE STATUS

| | NORMAL MODE | CONCENTRATION-UP MODE | |
|---|---|---|---|
| | DEVELOPER | DEVELOPING ROLLER | SHORTEST |
| REMAINING AMOUNT | 20% | 10% | |
| NUMBER OF USABLE SHEETS | 12,000 SHEETS | 3,000 SHEETS | 3,000 SHEETS |
| NUMBER OF USABLE DAYS | 60 DAYS | 15 DAYS | 15 DAYS |

FIG.11B

CARTRIDGE STATUS

| | NORMAL MODE | CONCENTRATION-UP MODE | |
|---|---|---|---|
| | DEVELOPER | DEVELOPING ROLLER | SHORTEST |
| REMAINING AMOUNT | 20% | 10% | |
| NUMBER OF USABLE SHEETS | 500 SHEETS | 1,500 SHEETS | 500 SHEETS |
| NUMBER OF USABLE DAYS | 2 DAYS | 6 DAYS | 2 DAYS |

FIG.14

CARTRIDGE STATUS

REMAINING AMOUNT 20%

| | NORMAL MODE | TONER SAVE MODE | MIXED |
|---|---|---|---|
| NUMBER OF USABLE SHEETS | 6,000 SHEETS | 7,500 SHEETS | 7,000 SHEETS |

IMAGE FORMING APPARATUS

BACKGROUND OF THE INVENTION

Field of the Invention

The present invention relates to an image forming apparatus.

Description of the Related Art

Since an image forming apparatus consumes developer as the apparatus forms an image, there is proposed a configuration of displaying the number of printable sheets of a cartridge storing the developer as disclosed in Japanese Patent Application Laid-open No. 2004-361752. Meanwhile, there is also proposed a configuration that enables to execute two image forming operations consuming different amounts of developer in forming a same image as disclosed in Japanese Patent Application Laid-open No. 2017-181964.

If the number of printable sheets or the number of usable sheets of a cartridge is displayed as described in Japanese Patent Application Laid-open No. 2004-361752 without distinguishing the two image forming operations, i.e., two modes, in the configuration described in Japanese Patent Application Laid-open No. 2017-181964, there is a possibility that it is unable to form images on a number sheets expected by a user. For instance, if a frequency of using a mode in which much amount of developer is consumed increases in a case where if the number of usable sheets is displayed based on a mode in which a less amount of developer is consumed, there is a possibility that a cartridge replacing timing comes before reaching the number of usable sheets displayed. Note that it is conceivable to display also the number of usable days, instead of the number of usable sheets, and the same applies also in this case.

SUMMARY OF THE INVENTION

Accordingly, the present disclosure provides an image forming apparatus configured to inform a user of a replacing timing of a developing cartridge when toner images are to be formed respectively at a first image forming mode and a second image forming mode in which a maximum loading amount of a toner image is different from each other in a case where a remaining developer amount within the developing cartridge reaches a predetermined level.

According to a first aspect of the present disclosure, an image forming apparatus configured to form a toner image on a recording material, includes an image forming unit including an image bearing member and a developing cartridge configured to store developer and having a developer bearing member configured to bear and convey the developer stored in the developing cartridge toward a position where an electrostatic latent image formed on the image bearing member is developed, a control portion configured to cause the image forming unit to form the toner image in one mode selected from a plurality of modes including a first image forming mode for forming a first toner image whose maximum loading amount is a first loading amount and a second image forming mode for forming a second toner image whose maximum loading amount is a second loading amount different from the first loading amount, a detection unit configured to detect a developer amount within the developing cartridge, and a display portion configured to display information related to the number of sheets of a recording material on which the first toner images can be formed in the first image forming mode in a case where the developer amount within the developing cartridge detected by the detection unit reaches a predetermined amount and information related to the number of sheets of a recording material on which the second toner images can be formed in the second image forming mode in a case where the developer amount within the developing cartridge detected by the detection unit reaches the predetermined amount.

According to a second aspect of the present disclosure, an image forming apparatus configured to form a toner image on a recording material, includes an image forming unit including an image bearing member and a developing cartridge configured to store developer and having a developer bearing member configured to bear and convey the developer stored in the developing cartridge toward a position where an electrostatic latent image formed on the image bearing member is developed, a control portion is configured to cause the image forming unit to form the toner images in one mode selected from a plurality of modes including a first image forming mode for forming a first toner image whose maximum loading amount is a first loading amount and a second image forming mode for forming a second toner image whose maximum loading amount is a second loading amount different from the first loading amount, a detection unit configured to detect a developer amount within the developing cartridge, and a display portion configured to display information related to the number of days during which the first toner images can be formed in the first image forming mode by using the developing cartridge in a case where the developer amount within the developing cartridge detected by the detection unit reaches a predetermined amount and information related to the number of days during which the second toner images can be formed in the second image forming mode by using the developing cartridge in a case where the developer amount within the developing cartridge detected by the detection unit reaches the predetermined amount.

According to a third aspect of the present disclosure, an image forming apparatus configured to communicate with an external device and to form a toner image on a recording material, includes an image forming unit including an image bearing member and a developing cartridge configured to store developer and having a developer bearing member configured to bear and convey the developer stored in the developing cartridge toward a position where an electrostatic latent image formed on the image bearing member is developed, a control portion configured to cause the image forming unit to form the toner image in one mode selected from a plurality of modes including a first image forming mode for forming a first toner image whose maximum loading amount is a first loading amount and a second image forming mode for forming a second toner image whose maximum loading amount is a second loading amount different from the first loading amount, a detection unit configured to detect a developer amount within the developing cartridge, and a transmission portion configured to transmit information related to the number of sheets of a recording material on which the first toner images can be formed in the first image forming mode in a case where a developer amount within the developing cartridge detected by the detection unit reaches a predetermined amount and information related to the number of sheets of a recording material on which the second toner images can be formed in the second image forming mode in a case where the developer amount within the developing cartridge detected by the detection unit reaches the predetermined amount, respectively, to the external device.

According to a fourth aspect of the present disclosure, an image forming apparatus configured to communicate with an external device and to form a toner image on a recording material, includes an image forming unit including an image bearing member and a developing cartridge configured to store developer and having a developer bearing member configured to bear and convey the developer stored in the developing cartridge toward a position where an electrostatic latent image formed on the image bearing member is developed, a control portion configured to cause the image forming unit to form the toner image in one mode selected from a plurality of modes including a first image forming mode for forming a first toner image whose maximum loading amount is a first loading amount and a second image forming mode for forming a second toner image whose maximum loading amount is a second loading amount different from the first loading amount, a detection unit configured to detect a developer amount within the developing cartridge, and a transmission portion configured to transmit information related to the number of days during which the first toner images can be formed in the first image forming mode in a case where the developer amount within the developing cartridge detected by the detection unit reaches a predetermined value and information related to the number of days during which the second toner images can be formed in the second image forming mode in a case where the developer amount within the developing cartridge detected by the detection unit reaches the predetermined amount, respectively, to the external device.

Further features of the present invention will become apparent from the following description of exemplary embodiments with reference to the attached drawings.

BRIEF DESCRIPTION OF THE DRAWINGS

FIG. 10 is a table indicating status values of the normal mode and of the concentration-up mode of the cartridge of the first embodiment.

FIG. 11A illustrates a cartridge status screen in a normal mode of a second embodiment.

FIG. 11B illustrates a cartridge status screen in the concentration-up mode of the second embodiment.

FIG. 14 illustrates a cartridge status screen of the third embodiment.

DESCRIPTION OF THE EMBODIMENTS

First Embodiment

Figure 1:
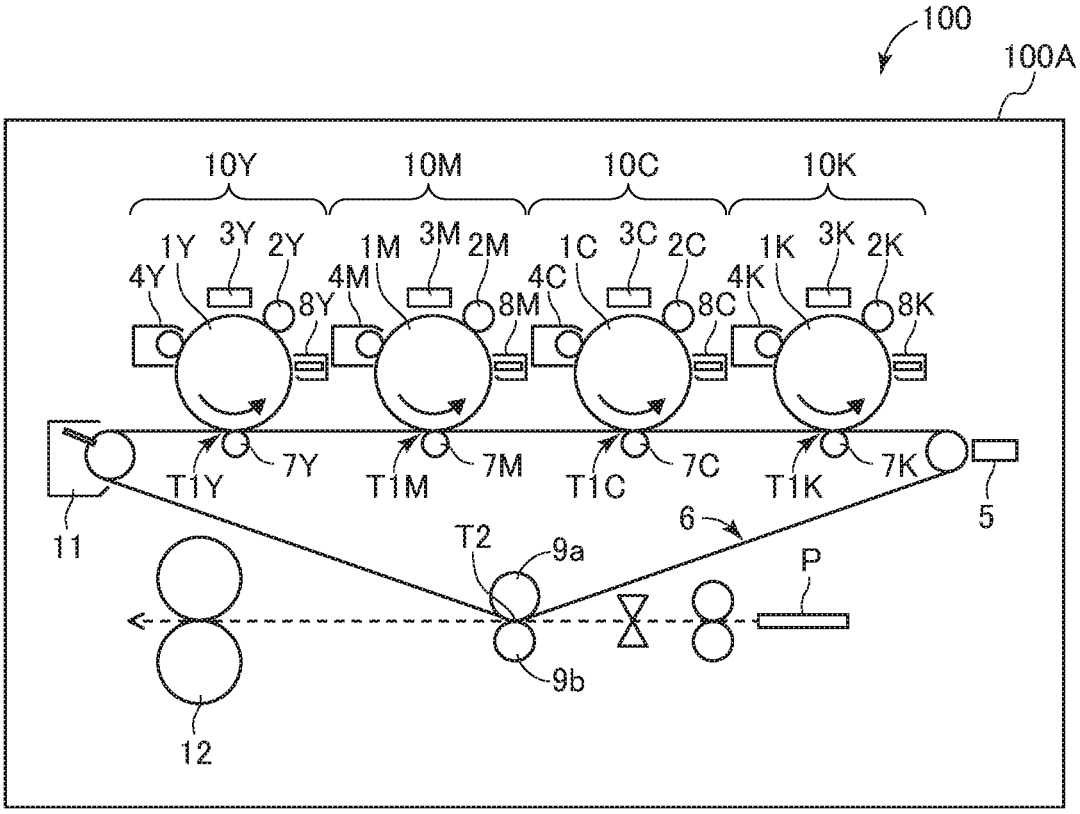
FIG. 1 is a schematic diagram illustrating a configuration of an image forming apparatus of a first embodiment.

A first embodiment of the present disclosure will be described below with reference to FIGS. 1 through 10. Firstly, a configuration of an image forming apparatus of the present embodiment will be schematically described with reference to FIGS. 1 and 2.

Image Forming Apparatus

The image forming apparatus 100 is an electro-photographic full-color printer including four image forming stations 10Y, 10M, 10C and 10K respectively having photosensitive drums 1Y, 1M, 1C and 1K serving as image bearing members. The image forming apparatus 100 is configured to form a toner image, i.e., an image, on a recording member P corresponding to image signals transmitted from a document reading apparatus (not illustrated) connected to an apparatus body 100A or an external device such as a personal computer communicably connected to the image forming apparatus 100A. The recording member includes a sheet of paper, a plastic film and a sheet member such as a cloth. The image forming stations 10Y, 10M, 10C and 10K form toner images of yellow, magenta, cyan and black, respectively.

Note that the image forming stations 10Y, 10M, 10C and 10K of the image forming apparatus 100 have substantially the same configuration except that colors to be developed are different. Accordingly, the image forming station 10Y will be typically described below and a description of the other image forming stations will be omitted.

The image forming station 10Y is provided with the photosensitive drum 1Y which is a cylindrical photosensitive member and which serves as an image bearing member. The photosensitive drum 1Y is rotationally driven in a direction of an arrow indicated in FIG. 1 and is capable of bearing an electrostatic latent image. Disposed around the photosensitive drum 1Y are a charging roller 2Y serving as a charging unit, a developing unit 4Y, a primary transfer roller 7Y and a cleaning unit 8Y. An exposing unit, i.e., a laser scanner, 3Y is disposed above the photosensitive drum 1Y in FIG. 1.

Still further, an intermediate transfer belt 6 is disposed so as to face the photosensitive drums 1Y, 1M, 1C and 1K. The intermediate transfer belt 6 is stretched by a plurality of tension rollers and is circularly moved in a direction of an arrow in FIG. 1 by being driven by a driving roller within the plurality of tension rollers. A secondary transfer outer roller 9*b* is disposed at a position facing, through the intermediate transfer belt 6, a secondary transfer inner roller 9*a* among the plurality of tension rollers, and composes a secondary transfer portion T2 where a toner image on the intermediate transfer belt 6 is transferred onto the recording member P. A fixing unit 12 is disposed downstream of the secondary transfer portion T2 in a recording member conveyance direction.

A process for forming an image by the image forming apparatus 100 constructed as described above will be described below. Firstly, as an image forming operation starts, a surface of the rotating photosensitive drum 1Y is homogeneously charged by the charging roller 2Y to which a predetermined charging bias is applied. Next, the photosensitive drum 1Y is exposed with a laser beam corresponding to an image signal emitted from the exposing unit 3Y Thereby, an electrostatic latent image corresponding to the image signal is formed on the photosensitive drum 1Y. The electrostatic latent image on the photosensitive drum 1Y is developed and visualized as a toner image by toner 41 (see FIG. 2) stored within the developing unit 4Y.

The toner image formed on the photosensitive drum 1Y is primarily transferred onto the intermediate transfer belt 6 at a primary transfer portion T1Y composed of the photosensitive drum 1Y and a primary transfer roller 7Y disposed across the intermediate transfer belt 6. After the primary transfer, the toner, i.e., transfer residual toner, left on the surface of the photosensitive drum 1Y is removed by the cleaning unit 8Y.

Such operation is then sequentially carried out by the respective image forming units of magenta, cyan and black, and four toner images are superimposed on the intermediate transfer belt 6. After that, the recording member P stored in a recording member storing cassette (not illustrated) is conveyed to the secondary transfer portion T2 while synchronizing with the toner image forming timing, and the four color toner images on the intermediate transfer belt 6 are secondarily and collectively transferred onto the recording member P. Toner left on the intermediate transfer belt 6 without being transferred at the secondary transfer portion T2 is removed by an intermediate transfer belt cleaner 11.

Next, the recording member P is conveyed to the fixing unit 12. Then, the fixing unit 12 melts and blends the toners on the recording member P by heating and pressing the recording member P to fix as a full-color image on the recording member P. After that, the recording member P is discharged out of the apparatus. Note that in a case where a duplex mode of forming an image on a back of the recording member P is selected, the recording member P on which the toner image has been fixed on one surface thereof is conveyed to a reverse conveyance path (not illustrated) to reverse front and back surfaces of the recording member P. Then, the recording member P is conveyed again to the secondary transfer portion T2 to form an image on the back surface of the recording member P in the same manner as described above. Thereby, a series of steps of the image forming process ends. Note that it is also possible to form a mono-color or plural-color image selectively by using only necessary image forming unit(s).

Still further, a concentration detection sensor 5 is disposed at a position facing the intermediate transfer belt 6 downstream of the primary transfer portion T1K and upstream of the secondary transfer portion T2 in terms of the rotation direction of the intermediate transfer belt 6. The concentration detection sensor 5 is configured to be able to detect concentration of the toner image on the intermediate transfer belt 6. For instance, a controlling toner image, i.e., a patch image, is formed on the intermediate transfer belt 6, and the concentration detection sensor 5 detects concentration of the patch image. Thus, the concentration detection sensor 5 is used in controlling the concentration adjustment of the toner image by controlling intensity of exposure of the exposing units 3Y through 3K and various voltages, for example.

Developing Unit

Figure 2:
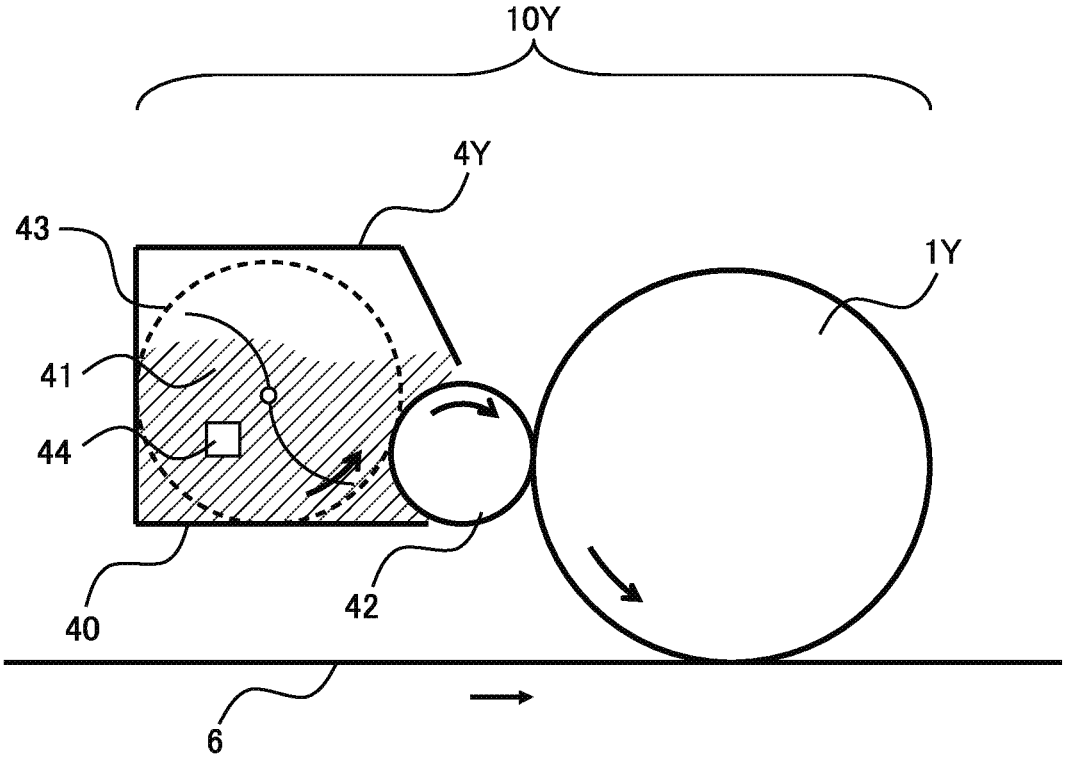
FIG. 2 is a schematic diagram illustrating a part of a configuration of an image forming station of the first embodiment.

Next, the developing unit 4Y will be described in detail with reference to FIG. 2. FIG. 2 illustrates the developing unit 4Y and the photosensitive drum 1Y in the image forming station 10Y. The developing units 4Y through 4K of the present embodiment are removably attached to the image forming apparatus 100A (see FIG. 1) as development cartridges respectively storing developer. Because the developing units 4Y through 4K have the same structure, only the developing unit 4Y will be described with reference to FIG. 2 and a description of the other developing units will be omitted.

The developing unit 4Y includes a storage container 40, a developing roller 42 serving as a developer bearing member, a supply member 43 and a remaining toner amount sensor 44. The storage container 40 stores the nonmagnetic toner 41 indicated by a hatched part in FIG. 2 and serving as the developer. The developer used in the present embodiment is one-component developer containing the nonmagnetic toner. The developing roller 42 is disposed rotatably at an opening part formed at a position facing the photosensitive drum 1Y of the storage container 40. The developing roller 42 bears and conveys the toner 41 as the roller rotates in a direction of an arrow in FIG. 2 and develops the electrostatic latent image borne on the photosensitive drum 1Y by the toner 41. At this time, a predetermined developing bias is applied to the developing roller 42. The supply member 43 supplies the toner 41 in the storage container 40 to the developing roller 42. The supply member 43 supplies the toner 41 to the developing roller 42 within the storage container 40 while agitating the toner 41 by rotating in a direction of an arrow in FIG. 2. The remaining toner amount sensor 44 is provided on a wall surface of the storage container 40 to detect a remaining toner amount within the storage container 40.

Detection of Remaining Toner Amount

Figure 3A:
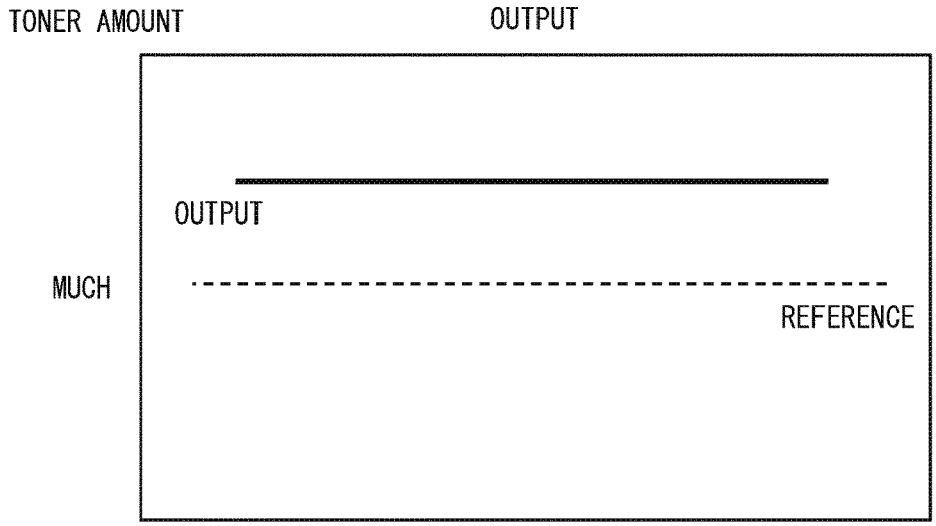
FIG. 3A is a chart illustrating a relationship between a toner amount of a remaining toner amount sensor and an output of the sensor in a state in which the toner amount is high.
Figure 3B:
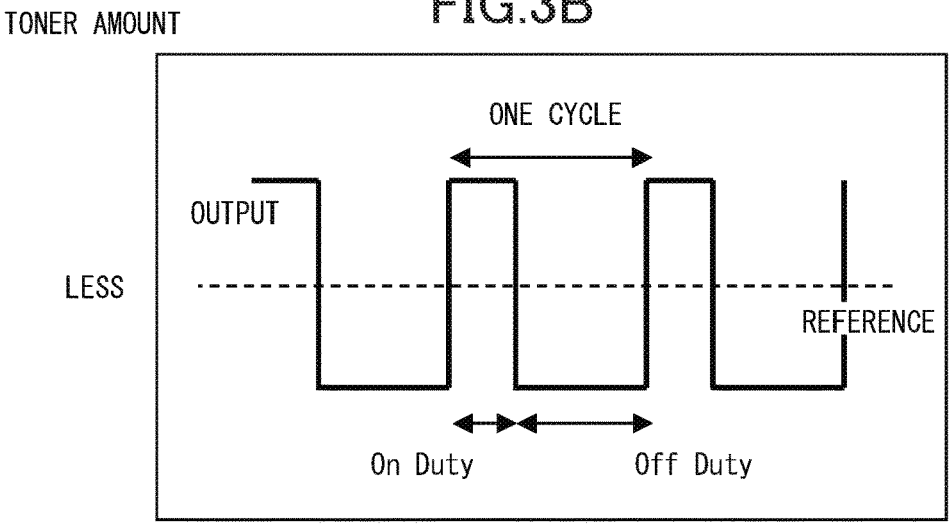
FIG. 3B is a chart illustrating the relationship between the toner amount of the remaining toner amount sensor and the output of the sensor in a state in which the toner amount is low.
Figure 3C:
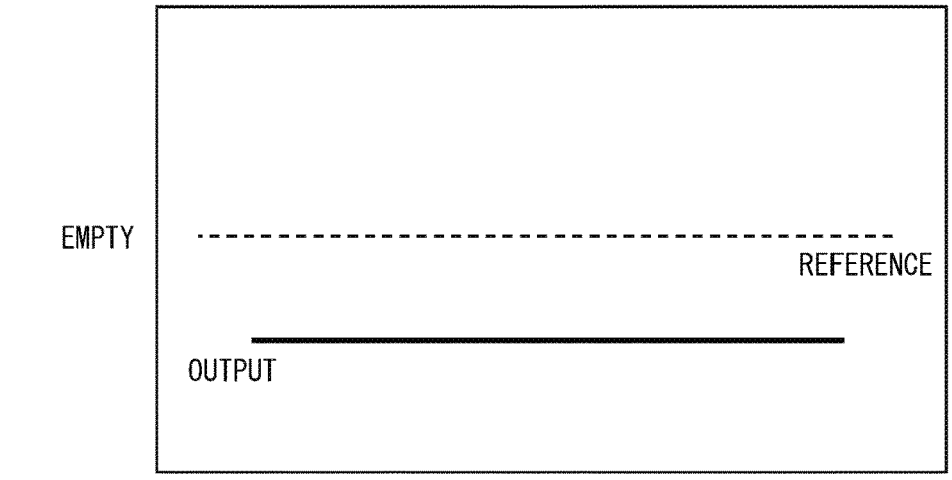
FIG. 3C is a chart illustrating the relationship between the toner amount of the remaining toner amount sensor and the output of the sensor in a state in which the toner amount is empty.

A method for detecting the remaining toner amount by the remaining toner amount sensor 44 will be described with reference to FIGS. 3A through 3C. According to the present embodiment, the remaining toner amount sensor 44 uses a piezoelectric device and increases an output thereof in a case where the toner 41 is present at a sensor counter surface. The toner 41 within the storage container 40 passes in front of the remaining toner amount sensor 44 by being agitated by the supply member 43. In a case where a toner amount is large, the output continues to be high as illustrated in FIG. 3A. Meanwhile, in a case where the toner amount is empty, the output with respect to the reference value continues to be low as illustrated in FIG. 3C.

Then, in a case where the toner amount is small, the output of the sensor repeats On and Off by reflecting cases where the toner 41 is present and is absent in front of the counter surface of the remaining toner amount sensor 44 as the supply member 43 rotates and agitates the toner. As a result, as indicated by the graph in FIG. 3B, the output repeats an On Duty time during which the toner 41 is detected and an Off Duty time during which no toner 41 is detected in connection with an agitation cycle of the supply member 43. Because the supply member 43 includes two agitation blades, a half rotation of the supply member 43 corresponds to one cycle in FIG. 3B. Because the toner amount is strongly correlated with the On Duty (Off Duty) time, it is possible to detect the toner amount from the On Duty (Off Duty) time.

Note that the remaining toner amount from a position where the remaining toner amount within the storage container 40 is full to a position where the remaining toner amount sensor 44 can detect On Duty and Off Duty, and the remaining toner amount from that position to a position where the remaining toner amount within the storage container 40 is detected to be empty can be found as follows. For instance, the remaining toner amount can be found by a dot count method for finding a toner consumption amount by counting each individual image signal forming a dot used in general, i.e., a video count value. According to the present embodiment, the remaining toner amount is detected by a system including the dot count method and the remaining toner amount sensor 44.

Control Portion

Figure 4:
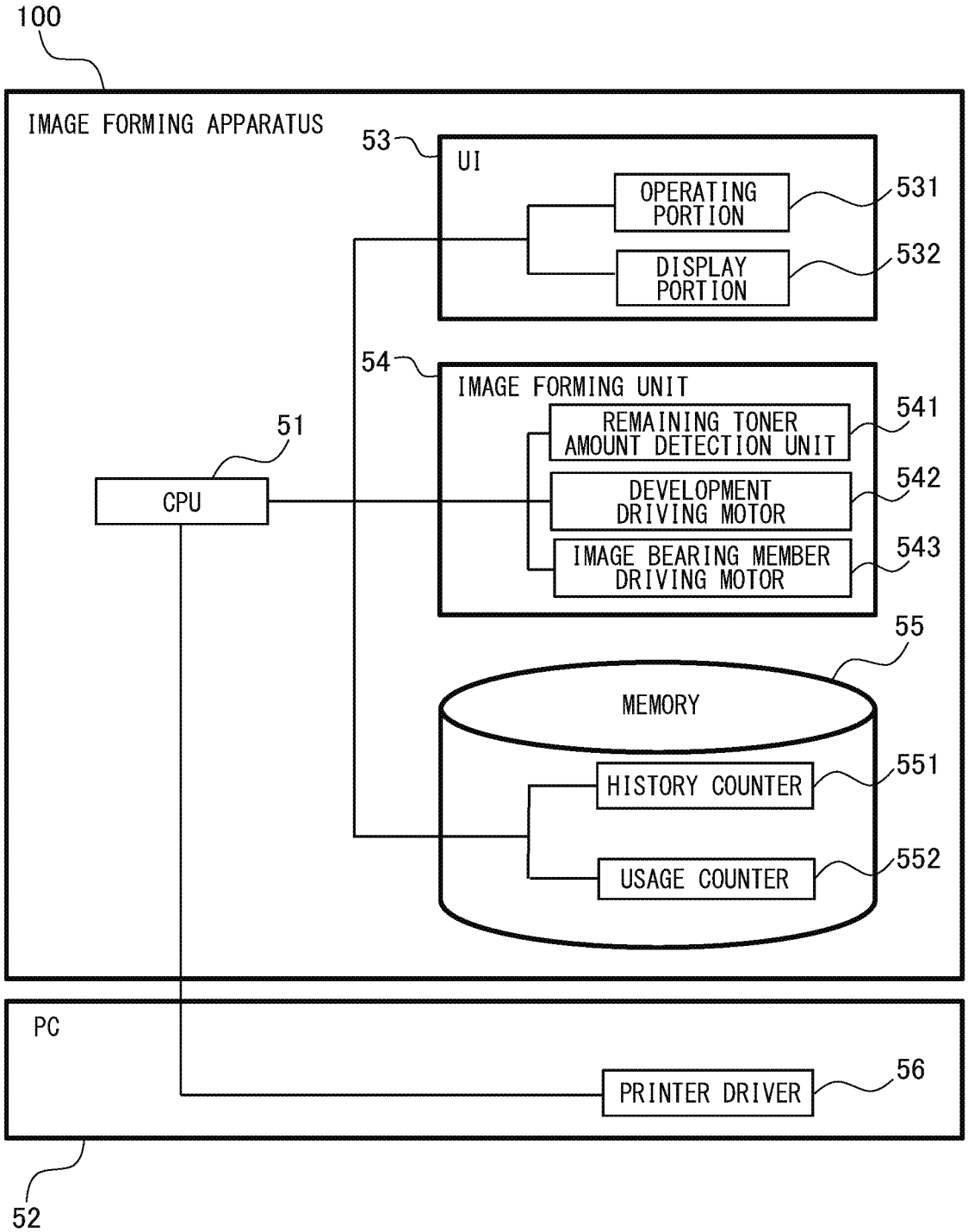
FIG. 4 is a control block diagram of the image forming apparatus of the first embodiment.

Next, a control system of the image forming apparatus 100 will be described with reference to FIG. 4. The image forming apparatus 100 is connected with a personal computer (PC) 52 or the like serving as an external device through a network, a USB line and others. A printing job is inputted to a CPU 51 of the image forming apparatus 100 from the PC 52 through an application such as a printer driver 56. In a case where the image forming apparatus is a multi-function printer including a document reading apparatus, there is a case where an image read from a reader scanner (not illustrated) is inputted as a copying job.

The CPU 51 controlling the image forming apparatus 100 is connected with a User Interface (UI) 53, an image forming unit 54 and a memory 55. The UI 53 includes an operating portion 531 enabling the user to operate the image forming apparatus 100 and a display portion 532 displaying various information. The image forming unit 54 includes a remaining toner amount detection unit 541, a development driving motor 542 serving as a motor for driving the developing unit 4Y (4M, 4C and 4K) and an image bearing member driving motor 543 serving as a motor for driving the photosensitive drums 1Y (1M, 1C and 1K) and the intermediate transfer belt 6. The remaining toner amount detection unit 541 is provided in each of the developing units 4Y through 4K and detects a remaining toner amount of each of the developing units 4Y through 4K from both of a signal of the remaining toner amount sensor 44 and a toner consumption amount found by the dot count method. The remaining toner amount detection unit 541 corresponds to a detection unit configured to detect a developer amount within the development cartridge. The memory 55 includes a history counter 551, and a usage counter 552 described later.

Normal Mode and Concentration-Up Mode

The CPU 51 (see FIG. 4) serving as a control portion is capable of executing two modes of a normal mode, i.e., a first mode, and a concentration-up mode, i.e., a second mode, in the image forming apparatus 100 of the present embodiment. The normal mode and the concentration-up mode are different from each other in terms of a consumption amount of the developer even if same images are formed in the respective modes. A specific example will be described below.

The normal mode serving as a first image forming mode is a mode suitable for ordinary office use in printing and copying a text, a table, a presentation material and the like. In the normal mode, it is possible to form a toner image, i.e., a first toner image, whose maximum loading amount is a first loading amount. The concentration-up mode serving as a second image forming mode is a mode suitable for use in more clear graphic designs and in seeking grade of black, i.e., density. In the concentration-up mode, it is possible to form a toner image, i.e., a second toner image, whose maximum loading amount is a second loading amount different from the first loading amount.

In the concentration-up mode, a rotational speed of the developing roller 42 of the developers 4Y through 4K is doubled with respect to that in the normal mode. Thereby, a development amount of the toner 41 supplied to the photosensitive drums 1Y through 1K is doubled as compared to that in the normal mode, and a consumption amount of the toner 41 is doubled even if same image data is outputted. That is, a rate of the rotational speed of the developing roller to a rotational speed of the photosensitive drum in forming a toner image in the concentration-up mode is different from a rate of the rotational speed of the developing roller to the rotational speed of the photosensitive drum in forming a toner image in the normal mode. In the present embodiment, the rotational speed of the developing roller is differentiated while keeping the rotational speed of the photosensitive drum in the concentration-up mode and the normal mode.

Note that a method of increasing the concentration of the toner in the concentration-up mode is not limited only to the method described above. For instance, it is possible to relatively increase the rotational speed of the developing roller 42 more than that of the photosensitive drums 1Y through 1K by lowering rotational speeds of the components, e.g., the intermediate belt 6, the fixing unit 12 and others, of the image forming unit on and after the photosensitive drums 1Y through 1K, while keeping the rotational speed of the developing roller 42 as it is. That is, the rotational speed of the photosensitive drum may be differentiated while keeping the same rotational speed of the developing roller in the concentration-up mode and the normal mode. Still further, conditions for forming electrostatic latent images on the photosensitive drums 1Y through 1K, i.e., a charging bias of the charging roller 2, a developing bias of the developing units 4Y through 4K and output conditions of the exposing units 3Y through 3K may be changed. It is also possible to combine the condition of forming the electrostatic latent images with the change of the speed of the developing roller 42 and the image forming unit on and after the photosensitive drums 1Y through 1K.

Display Screen of PC

Figure 5:
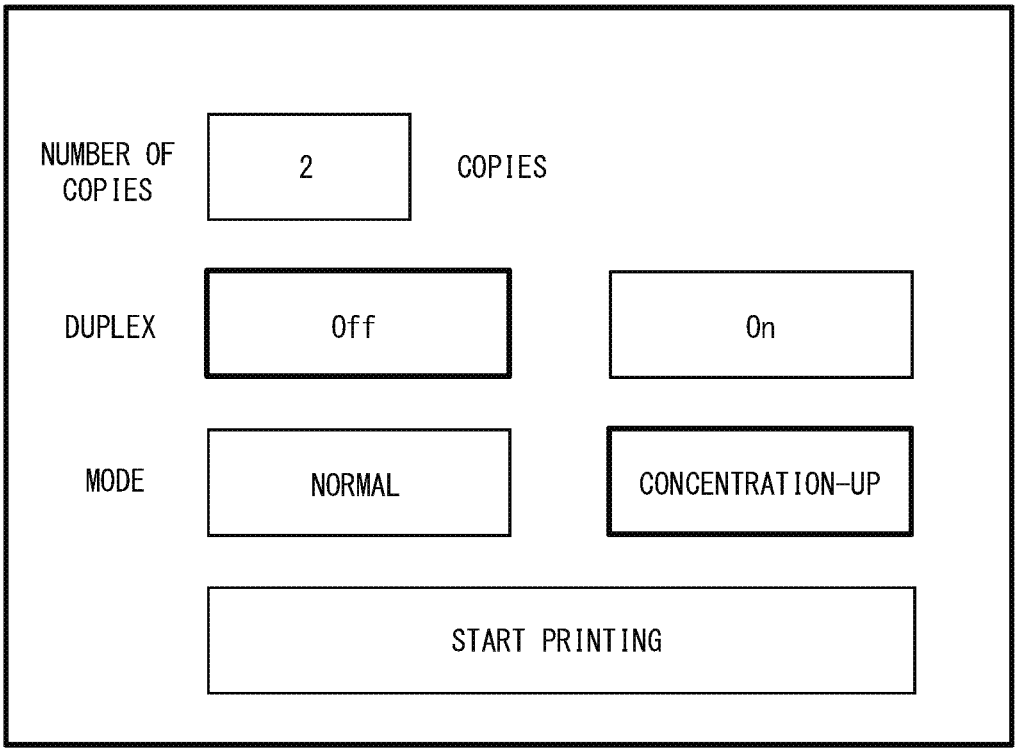
FIG. 5 illustrates a display screen of a printer driver in forming an image according to the first embodiment.

FIG. 5 illustrates a display screen of the printer driver 56 of the PC 52. Such screen is displayed when Print is selected from an arbitrary application on the PC 52. Here, the screen enables to set the number of sheets or the number of copies to be printed, i.e., the number of images to be formed, and to select either the normal mode or the concentration-up mode. On/Off of 'Duplex' enables to select whether a duplex mode is to be executed. Still further, 'Normal' corresponds to the 'normal mode' and 'Concentration-up' corresponds to the 'concentration-up mode', respectively, in the screen in FIG. 5. Then, a print job is inputted from the PC 52 to the image forming apparatus 100 by selecting 'Start Print'. Note that such screen may be displayed not only on the PC 52 but also on the UI 53 of the image forming apparatus 100 to be able to operate from the UI 53.

Display Screen of UI

Figure 6A:
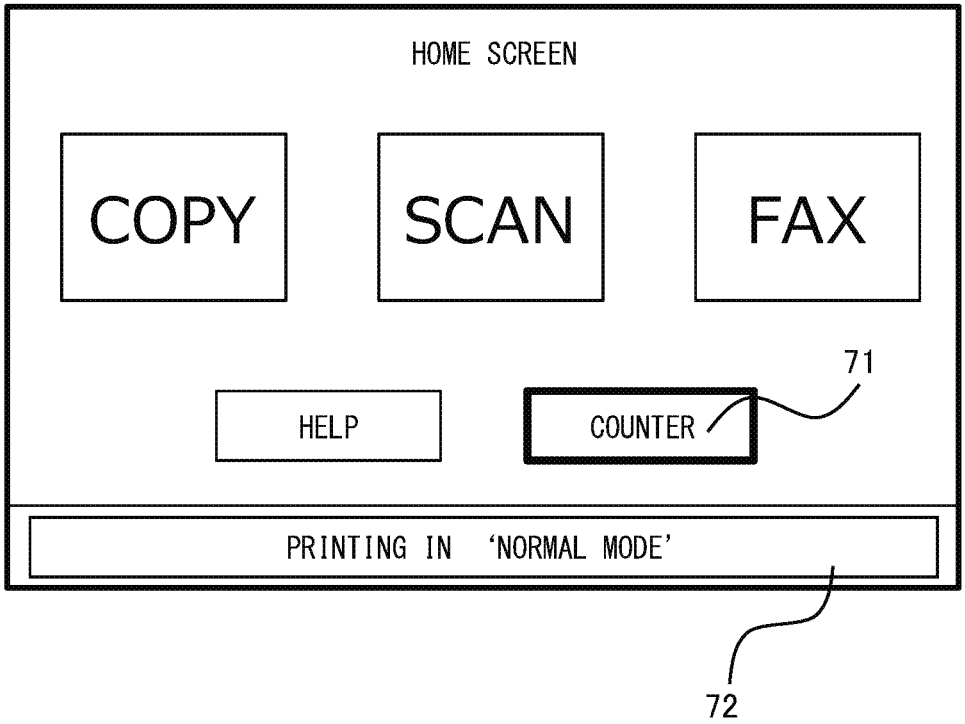
FIG. 6A is a screen displayed on a display portion of the image forming apparatus of the first embodiment and illustrating a state of a normal mode.
Figure 6B:
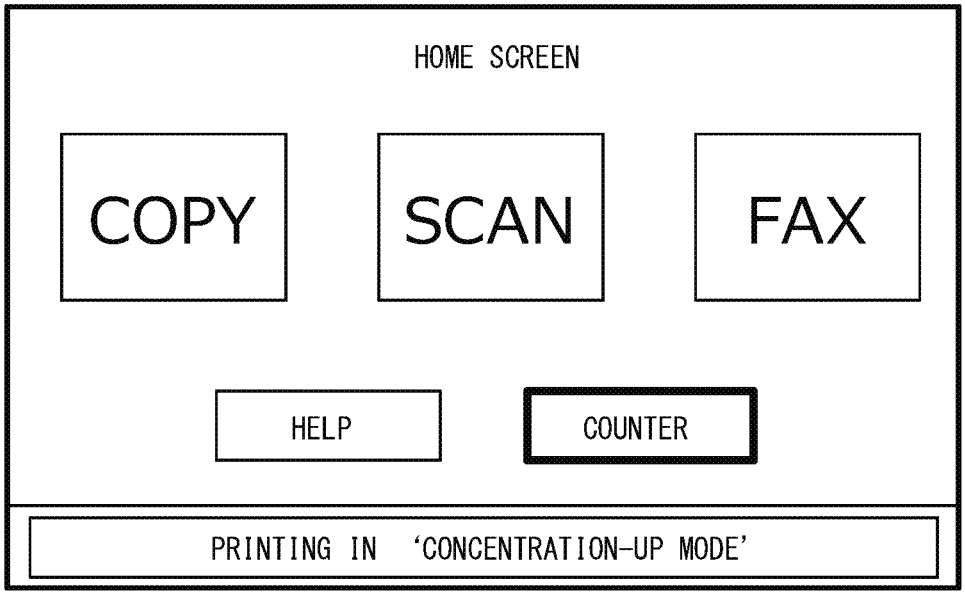
FIG. 6B is the screen displayed on the display portion of the image forming apparatus of the first embodiment and illustrating a state of a concentration-up mode.

FIGS. 6A and 6B illustrate display screens of the display portion 532 of the UI 53 (see FIG. 4) in the image forming apparatus 100. The UI 53 is formed of a touch panel and functions as the display portion 532 and the operating portion 531. A 'HOME screen' which is a standard screen includes a 'COPY' button by which the user copies, a 'SCAN' button by which an image is scanned from a reader scanner and is transmitted to the PC 52 and a 'FAX' button by which a facsimile function operates. The 'HOME screen' also includes a 'Help' button used in making reference when the user is troubled on how to use the apparatus and a 'Counter' button 71 for confirming usage of cartridges i.e., developing units 4Y through 4K in the present embodiment, which are consumables.

The respective functions start by touching the respective buttons. The screen also includes a status display area 72 notifying the user of a status of the image forming apparatus 100 at a lower part thereof. What has to be informed to the user such as an error, a JAM display indicating a paper jam and what is being executed, e.g., the normal mode or the concentration-up mode, is displayed in this area. Note that FIG. 6A illustrates a screen in a state of executing the 'normal mode' and FIG. 6B illustrates a screen in a state of executing the 'concentration-up mode', respectively.

Displays of Number of Usable Sheets and Number of Usable Days

Figure 7A:
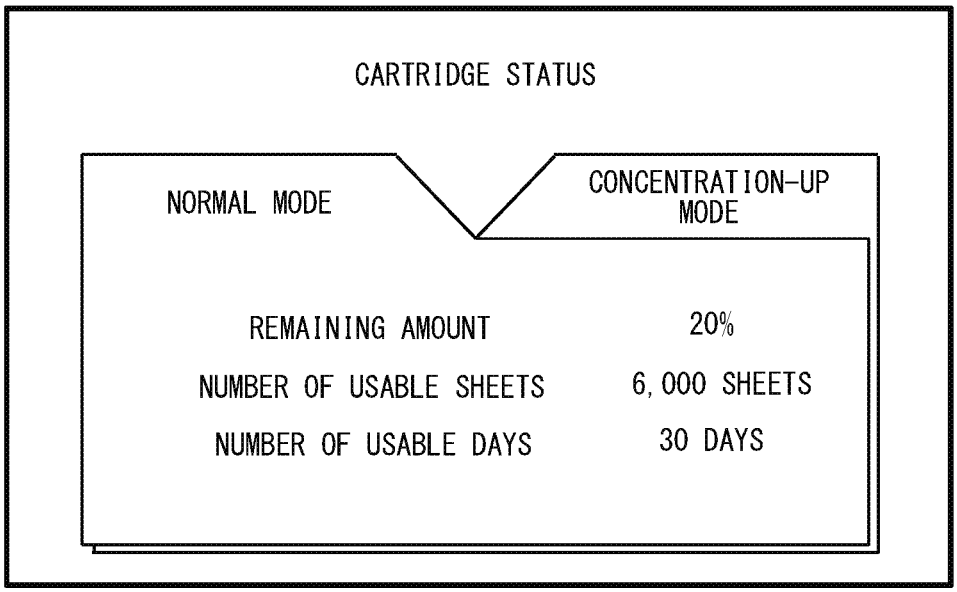
FIG. 7A illustrates a cartridge status screen in the normal mode of the first embodiment.
Figure 7B:
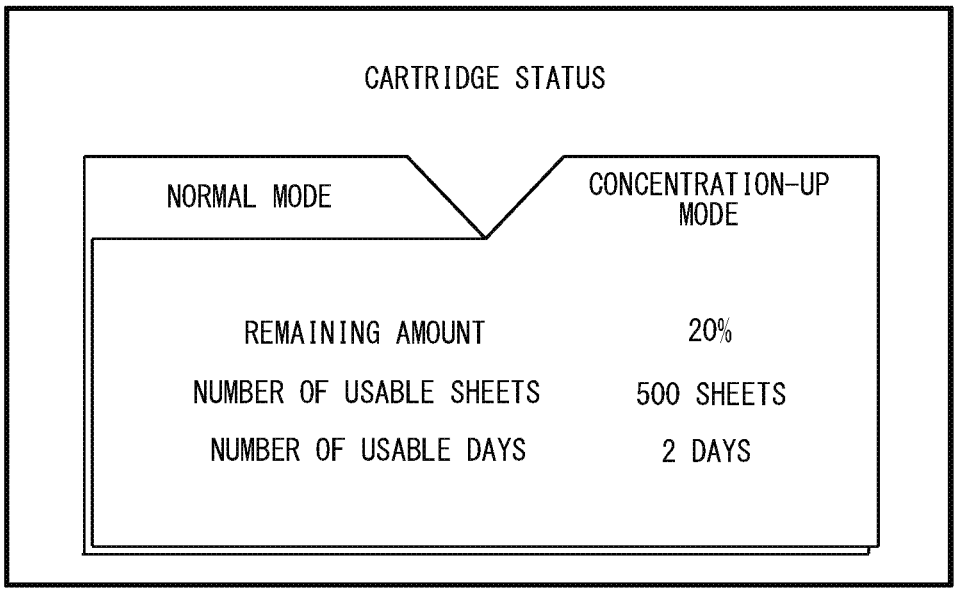
FIG. 7B illustrates the cartridge status screen in the concentration-up mode of the first embodiment.

Next, displays of the number of usable sheets of the recording material in the developing units 4Y through 4K (referred to as a 'cartridge' hereinafter) and the number of usable days of the cartridge will be described. As illustrated in FIGS. 7A and 7B, the display portion 532 serving as a display portion of the UI 53 can display the number of usable sheets of the recording material of the cartridge and the number of usable days of the cartridge corresponding respectively to the normal mode and the concentration-up mode. The number of usable sheets of the recording material or the number of usable days of the cartridge in the normal mode correspond to information related to the number of sheets of the recording material on which toner images can be formed or the number of days during which the cartridge can be used in the first image forming mode. The number of usable sheets of the recording material or the number of usable days of the cartridge in the concentration-up mode also correspond to information related to the number of sheets of the recording material on which toner images can be formed or the number of usable days during which the cartridge can be used in the second image forming mode. More specifically, the UI 53 enables to change over the screen displaying the number of usable sheets of the recording material and the number of usable days of the cartridge in the normal mode to/from the screen displaying the number of usable sheets of the recording material and the number of usable days of the cartridge in the concentration-up mode.

FIG. 7A is a screen displaying a cartridge status in a case where the normal mode is selected, and FIG. 7B is a screen displaying a cartridge status in a case where the concentration-up mode is selected. Each of the status screens displays a remaining developer amount within the cartridge, the number of usable sheets of the recording material in the cartridge and the number of usable days of the cartridge. In other words, in a case where the developer amount within the developing cartridge detected by the sensor reaches a predetermined amount, the information related to the number of sheets of the recording material on which the toner image can be formed and to the number of days during which the cartridge can be used in the normal mode and in the concentration-up mode are displayed on the UI 53. Note that it is also possible to arrange so as to display either one of the number of usable sheets of the recording material in the cartridge and the number of usable days of the cartridge on the respective status screens.

Such status screen may be displayed also on a display screen of the printer driver 56 of the PC 52. In this case, the CPU 51 serving as a transmission portion can transmit at least one of the number of usable sheets of the recording material in the cartridge and the number of usable days of the cartridge corresponding respectively to the normal mode and the concentration-up mode to the PC 52 serving as an external device. It is also possible to arrange such that the CPU 51 transmits at least one of the number of usable sheets of the recording material in the cartridge and the number of usable days of the cartridge corresponding respectively to the normal mode and the concentration-up mode to a system managing a life of the cartridge such as an external server.

Calculation of Number of Usable Sheets and Number of Usable Days

Next, calculation of the number of usable sheets of the recording material in the cartridge and the number of usable days of the cartridge will be described with reference to FIGS. 8 and 9. Firstly, a case where the normal mode is selected will be described. Suppose that the user selects 'two' copies of three page images of a normal office use, 'Off' regarding Duplex and 'Normal' mode and starts to output by pressing 'Start Print' on the screen of the printer driver 56 (see FIGS. 4 and 5). Then, "Printing in Normal Mode" is displayed on the status display area 72 of the HOME screen as illustrated in FIG. 6A.

This process will be described below along a flowchart in FIG. 8. Because the mode is the normal mode in Step S2 in outputting a first page in Step S1, the CPU 51 updates a 'number-of-sheets counter_1' for use in the normal mode of the history counter 551 (see FIG. 4) by incrementing by +1 in Step S3. Then, the CPU 51 adds a toner amount X1 used to output one sheet to the 'toner usage counter_1' for use in the normal mode of the usage counter 552 (see FIG. 4) based on an output of the remaining toner amount detection unit 541 (see FIG. 4) to update the 'toner usage counter_1' in Step S4. At this time, the CPU 51 calculates and updates 'average toner usage amount_1' which is an average toner usage amount for use in the normal mode by using Equation 1 in Step S5, as follows. The 'average toner usage amount_1' is stored in the memory 55:

$$\text{average toner usage amount_1} = \text{toner usage counter_1} \div \text{number-of-sheets counter_1} \quad \text{Eq. 1}$$

Next, the CPU 51 confirms whether the cartridge, i.e., the developing unit, has not been replaced in Step S9 and in a case where the cartridge has been replaced, i.e., No in Step S9, the CPU 51 resets the 'toner usage counter_1' and the 'average toner usage amount_1' to zero in Step S10. In a case where the cartridge has not been replaced, i.e., Yes in Step S9, or after when the 'toner usage counter_1' and the 'average toner usage amount_1' have reset in Step S10, the CPU 51 confirms whether the job is to be finished in Step S11. If the job is not to be finished, i.e., No in Step S11, the process returns to Step S1. Then, the CPU 51 repeats the Steps S1 through S5 and Steps S9 through S11. Because two copies of three pages are formed in this example, the CPU 51 ends the job by repeating these processes by six times.

Next, a case where the user wishes to confirm for how many sheets the cartridge can be used further will be described. Firstly, the screen shifts to FIG. 7A as the user touches 'Counter' button 71 on the display screen in FIG. 6A of the UI 53. FIGS. 7A and 7B illustrate cartridge status screens on which information related to the cartridge is displayed. More specifically, a current remaining toner amount as compared to a case where a remaining toner amount of a new cartridge is 100%, the number of usable sheets and the number of usable days estimated corresponding to a use state of the user are displayed.

Values displayed here will be described along a flowchart in FIG. 9. When the 'Counter' button 71 in FIG. 6A is touched in Step S21, the CPU 51 determines a present mode in Step S22. Because the job being executed or the final job having been executed is the normal mode here, the CPU 51 calculates 'prediction counter_1' which is the number of usable sheets for use in the normal mode as follows in Step S23. That is, the CPU 51 calculates the "prediction counter_1" from a latest remaining toner amount detected by the remaining toner amount detection unit 541 and the 'average toner usage amount_1' which has been calculated in Step S5 in FIG. 8 by using Equation 2, as follows:

$$\text{prediction counter_1} = \text{remaining toner amount} \div \text{average toner usage amount_1} \quad \text{Eq. 2}$$

Next, the CPU 51 displays the 'prediction counter_1', i.e., the number of usable sheets, calculated by Equation 2 on the UI 53 as illustrated in FIG. 7A in Step S24. Because the remaining toner amount was 20% at present and the 'average toner usage amount_1' was 1/300 (%/sheet), the number of usable sheets is calculated to be '6,000 sheets'. An image outputted in the normal mode of the user was 5% of an area rate on average as compared to a case where an area rate of a full-page solid image is 100%. In the use state of the user, it is possible to output '30,000 sheets' in a case where the cartridge is replaced and the toner 41 within the cartridge is full (see FIG. 10). That is, a predicted number of usable sheets of the new cartridge is 30,000 sheets in the normal mode. Note that the number of used sheets indicated in FIG. 10 corresponds to a value in the history counter 551 (see FIG. 4) described above.

Figure 8:
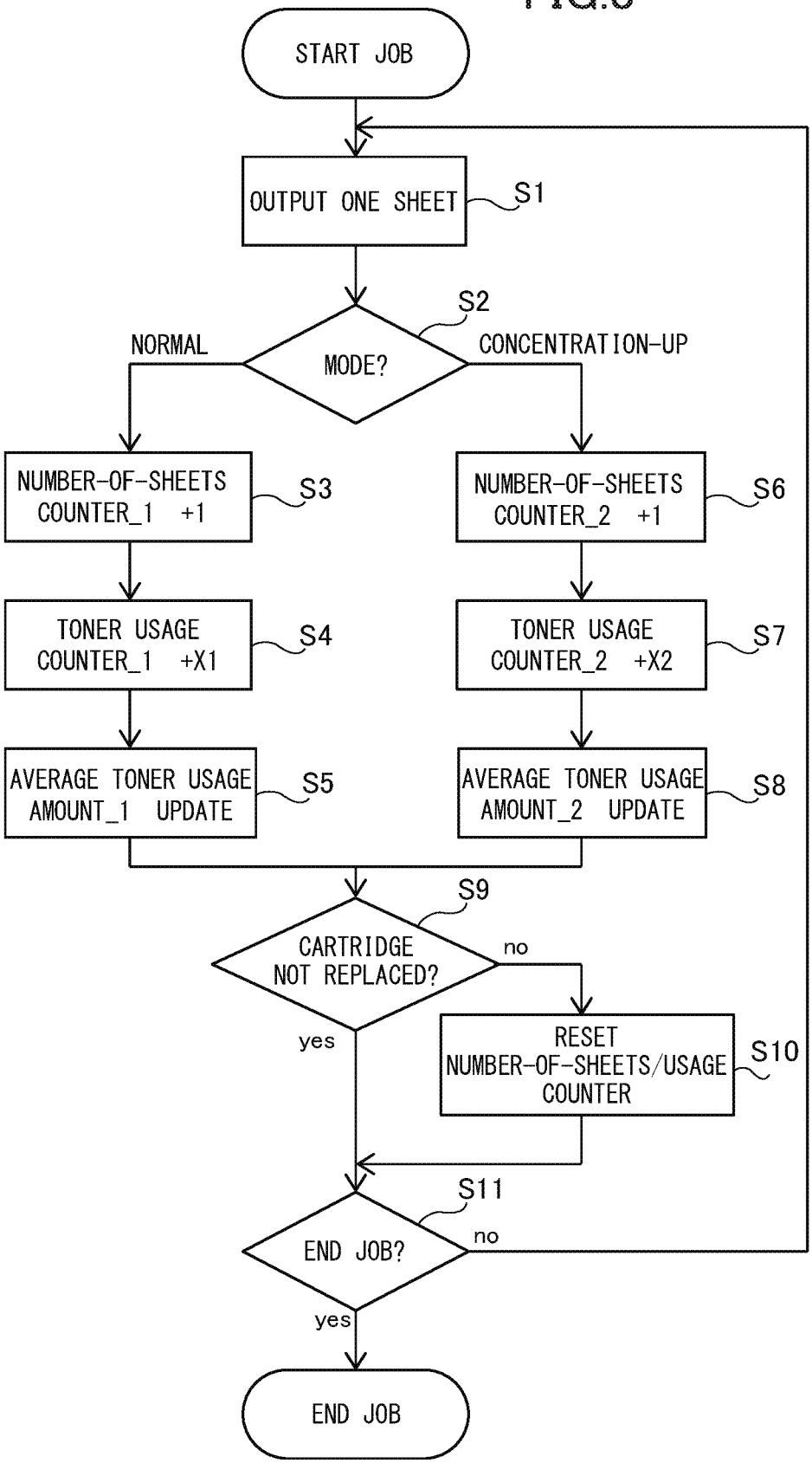
FIG. 8 is a flowchart in calculating an average toner usage amount of the normal mode and of the concentration-up mode of the first embodiment.
Figure 9:
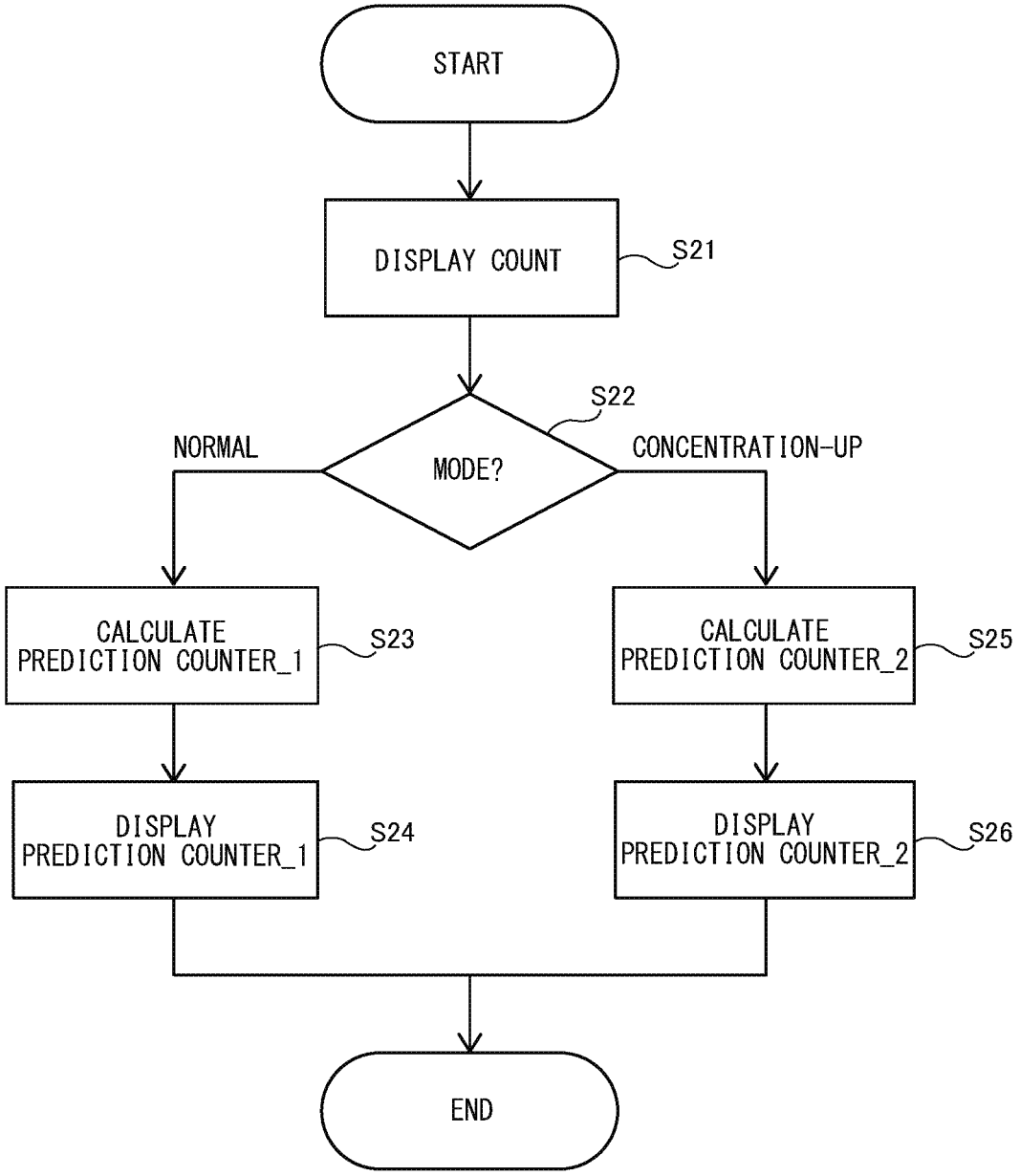
FIG. 9 is a flowchart in calculating and displaying prediction counters of the normal mode and of the concentration-up mode of the first embodiment.

The history counter 551 may also count the number of days in addition to the number-of-sheets counter_1 in Step S3 in FIG. 8. That is, the history counter 551 may include a number-of-days counter. It is possible to calculate also the number of usable days by using Equations 1 and 2 similarly to the case of the number of usable sheets. Specifically, in a case where the number-of-days counter for use in the normal mode is changed to 'number-of-days counter_1' and a toner usage amount per day is changed to 'average toner usage amount_1', the abovementioned Equation 1 can be modified as follows:

$$\text{average toner usage amount_1}' = \text{toner usage counter_1} \div \text{number-of-days counter_1} \quad \text{Eq. 1}'$$

Then, 'prediction counter_1' which is the number of usable days for use in the normal mode is calculated by modifying the abovementioned Equation 2, as follows:

$$\text{prediction counter_1}' = \text{remaining toner amount} \div \text{average toner usage amount_1}' \quad \text{Eq. 2}'$$

Because an output in the normal mode of the user was 200 sheets/day on average, the CPU 51 displays '30 days' which is the 'prediction counter_1', i.e., the number of usable days, as illustrated in FIG. 7A. Note that the 'number of usable days' may be calculated by dividing the number of usable sheets found from the remaining toner amount and the average toner usage amount by an average number of used sheets per day. In this case, it is not necessary to count a number-of-days by storing the number of used sheets in each mode of that day every day.

It is also possible to arrange such that the history counter 551 includes either one counter among the number-of-sheets counter_1 and the number-of-days counter_1. In this case, a display corresponding to the counter included in the history counter 551 is displayed on the UI 53. That is, in a case where the history counter 551 includes only the number-of-sheets counter_1, only the number of usable sheets is displayed, and in a case where the history counter 551 includes only the number-of-days counter_1, only the number of usable days is displayed.

Next, a case where the user selects the concentration-up mode will be described. Suppose that the user starts to output by selecting '20' copies of one page image that uses much toner for advertising a sale at a storefront for example, 'Off' regarding Duplex and 'Concentration-up' mode and by touching 'Start Print' in the screen of the printer driver 56 (see FIGS. 4 and 5). Then, "Printing in Concentration-up Mode" is displayed on the status display area 72 of the HOME screen as illustrated in FIG. 6B.

Because the mode is the concentration-up mode in Step S2 in outputting a first page in Step S1 in the flowchart in FIG. 8, the CPU 51 updates a 'number-of-sheets counter_2' for use in the concentration-up mode of the history counter 551 by incrementing by +1 in Step S6. Then, the CPU 51 adds a toner amount X2 used to output one sheet to the 'toner usage counter_2' for use in the concentration-up mode of the usage counter 552 based on an output of the remaining toner amount detection unit 541 to update the 'toner usage counter_2' in Step S7. At this time, the CPU 51 calculates and updates 'average toner usage amount_2' which is an average toner usage amount for use in the concentration-up mode by using Equation 3 as follows in Step S8. The 'average toner usage amount_2' is stored in the memory 55:

$$\text{average toner usage amount_2} = \text{toner usage counter_2} \div \text{number-of-sheets counter_2} \quad \text{Eq. 3}$$

The CPU 51 repeats Steps S1 and S2 and Steps S6 through S11 until the job is ended in Step S11. Because images of 20 copies of one page are formed in this example, the CPU 51 ends the job by repeating these processes 20 times. Still further, in a case where the normal mode and the concentration-up mode are woven in one job, the CPU 51 repeats Steps S1 through S11 by judging the change-over in Step S2 per every page. That is, the remaining toner amounts in the abovementioned Equations 2 and 2' are remaining toner amounts actually left in the cartridge. Therefore, it is possible to find the number of usable sheets and the number of usable days in the respective modes even if the two modes are woven by dividing the remaining toner amounts by the average toner usage amounts in the respective modes.

Next, in a case where the user wishes to confirm for how many sheets the cartridge can be used further, the user touches 'Counter' button 71 on the display screen of FIG. 6B. Here, the screen shifts to FIG. 7B. Values displayed on FIG. 7B will be described along the flowchart in FIG. 9.

When the 'counter' button 71 in FIG. 6B is touched in Step S21, the CPU 51 determines a mode in Step S22. Because the job being executed or the final job having been executed is the concentration-up mode here, the CPU 51 calculates 'prediction counter_2' which is the number of usable sheets for use in the concentration-up mode as follows in Step S25. That is, the CPU 51 calculates the "prediction counter_2" from a latest remaining toner amount detected by the remaining toner amount detection unit 541 and the 'average toner usage amount_2' which has been calculated in Step S8 in FIG. 8 by using Equation 4, as follows:

$$\text{prediction counter_2} = \text{remaining toner amount} \div \text{average toner usage amount_2} \quad \text{Eq.4}$$

Next, the CPU 51 displays the 'prediction counter_2', i.e., the number of usable sheets, calculated by Equation 4 on the UI 53 as illustrated in FIG. 7B in Step S26. Because the remaining toner amount was 20% at present and the 'average toner usage amount_2' was 1/25 (%/sheet), the number of usable sheets is calculated to be '500 sheets'.

An image outputted in the concentration-up mode of the user was 30% of an area rate on average as compared to a case where an area rate of a full-page solid image is 100%. The area rate of an image in the concentration-up mode is higher than that of the normal mode by six times, and a toner usage amount in the concentration-up mode is doubled as compared to that in the normal mode even if same images are formed. Due to that, the average toner usage amount_2 in the concentration-up mode is 12 times that in the normal mode. Accordingly, a predicted number of usable sheets of a new cartridge in the concentration-up mode is 1/12 as compared to that in the normal mode. In the use state of this user, it is possible to output '2,500 sheets' in a case where the cartridge is replaced and the toner 41 within the cartridge is full (see FIG. 10). That is, a predicted number of usable sheets of the new cartridge is 2,500 sheets in the concentration-up mode.

Note that the CPU 51 calculates the number of usable days in the concentration-up mode in the same manner as with the case of the normal mode and displays the information on the UI 53. Because the output in the concentration-up mode of this user was 250 sheets/day on average, the CPU 51 calculates the number of usable days to be two days (see FIG. 7B). Still further, it is also possible to arrange such that the history counter 551 includes at least one of the counters of the number-of-sheets counter and the number-of-days counter for use in the concentration-up mode in the same manner as with the normal mode.

In the abovementioned description, the shift of the screens in FIGS. 7A and 7B was made by automatically selecting the display screen in FIG. 7A or in FIG. 7B corresponding to a mode of the job being presently executed or the job executed at last. However, the user can switch the displays to an arbitrary mode by touching tab parts (parts described as Normal Mode and Concentration-up Mode) in FIGS. 7A and 7B.

Still further, while the number of usable sheets has been displayed on the UI 53 in the abovementioned description, it is also possible to arrange so as to notify the user of how many sheets can be used further by displaying the predicted number of usable sheets and the number of used sheets described in the table in FIG. 10. That is, the number of usable sheets may be notified by displaying the predicted number of usable sheets and the number of used sheets.

The present embodiment enables the user to adequately grasp a cartridge replacing timing even in the configuration of executing the normal mode and the concentration-up mode in which the developer consumption amounts are different. That is, the user can adequately grasp a level of the timing when the cartridge is to be replaced in a mode to be used from now on by displaying the number of usable sheets and the number of usable days in each of the normal mode and the concentration-up mode.

Second Embodiment

Figure 12:
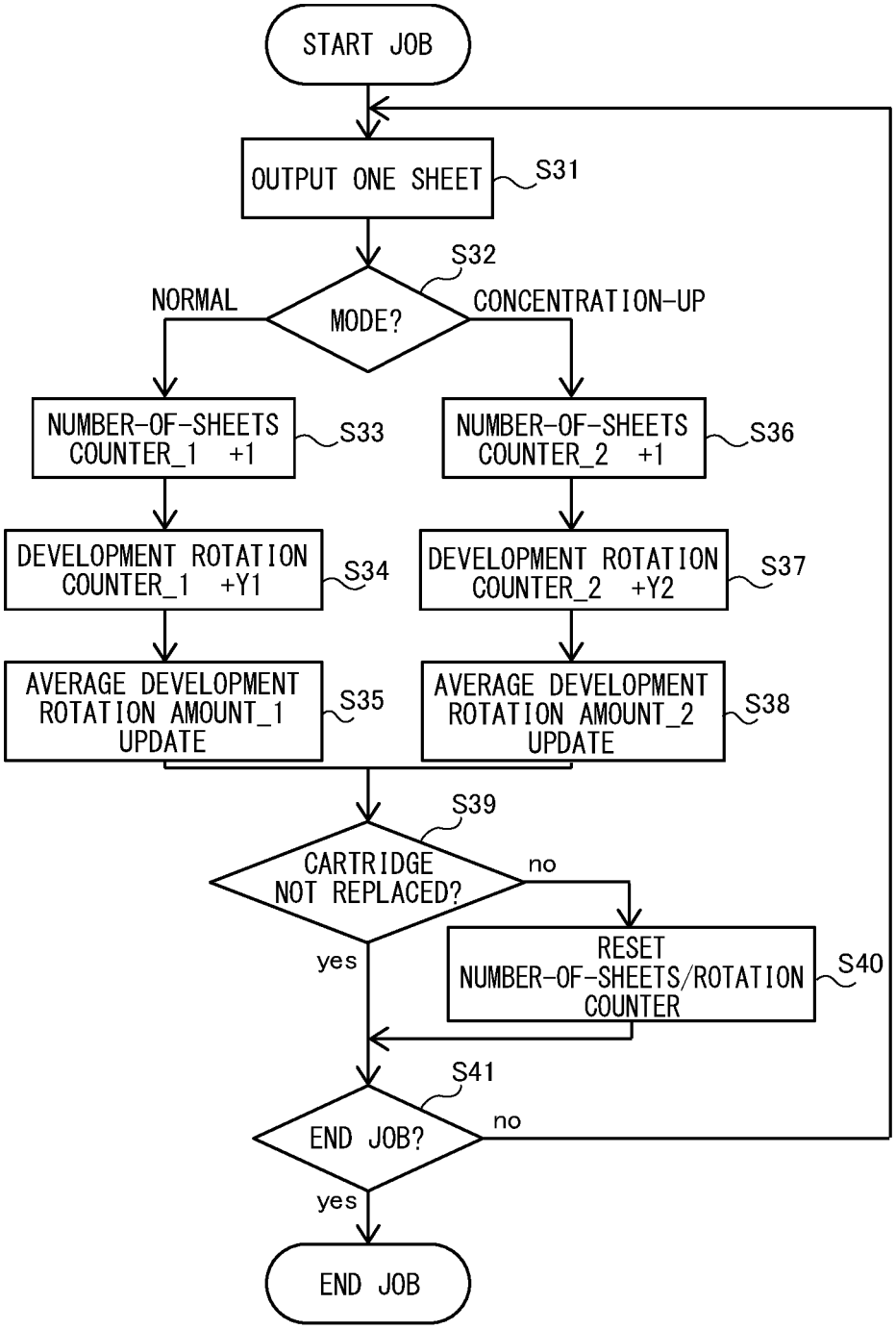
FIG. 12 is a flowchart in calculating an average rotation amount of a developing roller in the normal mode and in the concentration-up mode of the second embodiment.

A second embodiment of the present disclosure will be described by using FIGS. 11 and 12 and while making reference to FIGS. 1, 2 and 4. The number of usable sheets and the number of usable days of the cartridge were found from the toner usage amount and the remaining toner amount of the developing unit serving as the cartridge in the first embodiment described above. Meanwhile, the number of usable sheets and the number of usable days of a cartridge are found by considering a life of the developing roller 42 in the present embodiment. Because other configurations and operations are the same as those of the first embodiment, parts different from the first embodiment will be mainly described below by denoting same components with same reference signs and by omitting or simplifying their illustrations and descriptions.

The life of the developing units 4Y through 4K (see FIG. 1) depends not only on the remaining toner amount but also on the number of times of rotation of the developing roller 42. The developing roller 42 has a function of applying electric charge to the toner 41 and as its rotation increases, a surface of the developing roller 42 deteriorates and such function drops. In a case of generally forming images in the normal mode, a filling amount of the toner 41 and a life of the developing roller 42 are designed such that the toner 41 depletes earlier than the life of the developing roller 42. However, in a case where the user continues to output images whose rate of use of the toner 41 is low, e.g., images having a low rate of area, more than what has been assumed, there is a case where the life of the developing roller 42 comes to end before the depletion of the toner 41. Still further, in the case of the concentration-up mode, because the developing roller 42 rotates with a rotational speed of twice of that in the normal mode, the number of sheets of the recording material that can be used by the developing roller 42 become a half of that in the normal mode.

Then, according to the present embodiment, the display portion 532 of the UI 53 (see FIG. 4) displays the number of usable sheets and the number of usable days of the recording material corresponding respectively to the developer, i.e., toner, and the developing roller as illustrated in FIGS. 11A and 11B. In addition, the number of usable sheets and the number of usable days of shorter one or shortest one among them are displayed. It is possible to display the number of usable sheets of the recording material of the cartridge and the number of usable days of the cartridge corresponding respectively to the normal mode and the concentration-up mode on the UI 53 also in the present embodiment similarly to the first embodiment. Note that in the example illustrated in FIG. 11A, an average area rate of an image when the user uses the normal mode was 2.5% which is a half of the example illustrated in FIG. 7A of the first embodiment. Due to that, although the remaining toner amount is equally 20%, the number of usable sheets related to the developer is 12,000 sheets and the number of usable days is 60 days, which are doubled from those displayed in FIG. 7A.

Next, calculation of the number of usable sheets of a recording material of the cartridge and the number of usable days of the cartridge considering the life of the developing roller 42 will be described with reference to FIG. 12. The present embodiment also informs the user of a prediction value per mode similarly to the calculation based on the remaining toner amount of the first embodiment. Specifically, toner usage counters in Steps S4 and S7 in FIG. 8 of the first embodiment are substituted to Development rotation counters in Steps S34 and S37 which are counters of the number of times of rotation of the developing roller 42. Still further, average toner usage amounts in Steps S5 and S8 in FIG. 8 are substituted to Average development rotation amounts in Steps S35 and S38 which are average number of times of rotation of the developing roller 42. Then, average development rotation amount_1 in the normal mode and the average development rotation amount_2 in the concentration-up mode are calculated by Equations 5 and 6 by using development rotation counter_1 in the normal mode and development rotation counter_2 in the concentration-up mode, as follows:

average development rotation amount_1=development rotation counter_1+number-of-sheets counter_1 Eq. 5 average development rotation amount_2=development rotation counter_2+number-of-sheets counter_2 Eq. 6

The development rotation counter_1 and the development rotation counter_2 are updated by the usage counter 552 (see FIG. 4) that adds numbers of times of rotation Y1 and Y2, by which the developing roller 42 rotates in outputting one sheet, every time when one sheet is outputted. The CPU 51 (see FIG. 4) calculates and updates the average development rotation amount_1 and the average development rotation amount_2, respectively, by using Equations 5 and 6. These are stored in the memory 55. Steps S31 through S33, Step S36 and Steps S39 through 41 are the same respectively with Steps S1 through S3, Step S6 and Steps S9 through S11 in FIG. 8.

Then, the CPU 51 calculates the prediction counter_1 and the prediction counter 2 which are numbers of usable sheets in the normal mode and the concentration-up mode from the average development rotation amount_1 and the average development rotation amount_2 calculated as described above similarly to Equations 2 and 4 of the first embodiment. Specifically, the CPU 51 calculates them by Equations 7 and 8, as follows.

prediction counter_1=remaining toner amount÷average development rotation amount_1 Eq. 7 prediction counter_2=remaining toner amount÷average development rotation amount_2 Eq. 8

The prediction counter_1 and the prediction counter_2 calculated as described above are displayed on the UI 53 as the numbers of usable sheets similarly to the case described with reference to FIG. 9.

The number of usable days is also found in the same manner as with the first embodiment. For instance, the CPU 51 calculates similarly to the case described in terms of Equations 1' and 2' of the first embodiment. Specifically, in a case where the number-of-days counter for use in the normal mode is changed to 'number-of-days counter_1' and the number of times of rotation of the developing roller 42 per day is changed to 'average development rotation amount_1", the abovementioned Equation 5 is modified as follows:

average development rotation amount_1'=development rotation counter_1+number-of-days counter_1 Eq. 5'

Then, the abovementioned Equation 7 is modified to calculate the 'prediction counter_1' which is the number of usable days for use in the normal mode, as follows:

prediction counter_1'=remaining toner amount÷average development rotation amount_1' Eq. 7'

The CPU 51 calculates 'prediction counter_2" which is the number of usable days for use in the concentration-up mode similarly to the normal mode. Then, the CPU 51 displays the prediction counter_1' and the prediction counter_2' thus calculated on the UI 53 as the numbers of usable days.

In an exemplary screen in FIG. 11A, because a remaining life, i.e., a remaining amount, of the developing roller 42 is 10% and the number of usable sheets in the normal mode is 3,000 sheets, the number of usable days is predicted to be 15 days because the average number of used sheets is 200 sheets/day. Meanwhile in the concentration-up mode illustrated in FIG. 11B, because the rotational speed of the developing roller 42 per one sheet is doubled and the number of usable sheets is 1,500 sheets, the number of usable days is predicted to be 6 days because the average number of used sheets is 250 sheets/day.

Still further, either one of the toner 41 and the developing roller 42 which becomes unusable first is displayed by denoting as 'Shortest' in FIGS. 11A and 11B. Because the life of the developing roller 42 comes earlier in the case of the normal mode, the number of usable sheets is displayed as 3,000 sheets and the number of usable days is displayed as 15 days (see FIG. 11A). Meanwhile, because the toner 41 is predicted to be depleted first in a case of the concentration-up mode, the number of usable sheets is displayed as 500 sheets and the number of usable days is displayed as 2 days (see FIG. 11B).

As described above, in a case where there is a member that becomes a factor of the life, i.e., the developing roller 42 here, other than the toner 41 in the developing units 4Y through 4K, i.e., the cartridges, the CPU 51 calculates the number of usable sheets and the number of usable days per mode from the toner 41 and the developing roller 42 in the same manner as with the case of the toner 41. This arrangement enables the user to adequately grasp a level of a cartridge replacing timing in a mode used by the user. Note that the arrangement may be modified so as to display only a numerical value of the 'Shortest' as the number of usable sheets and the number of usable days of the cartridge in FIGS. 11A and 11B.

Third Embodiment

Figure 13:
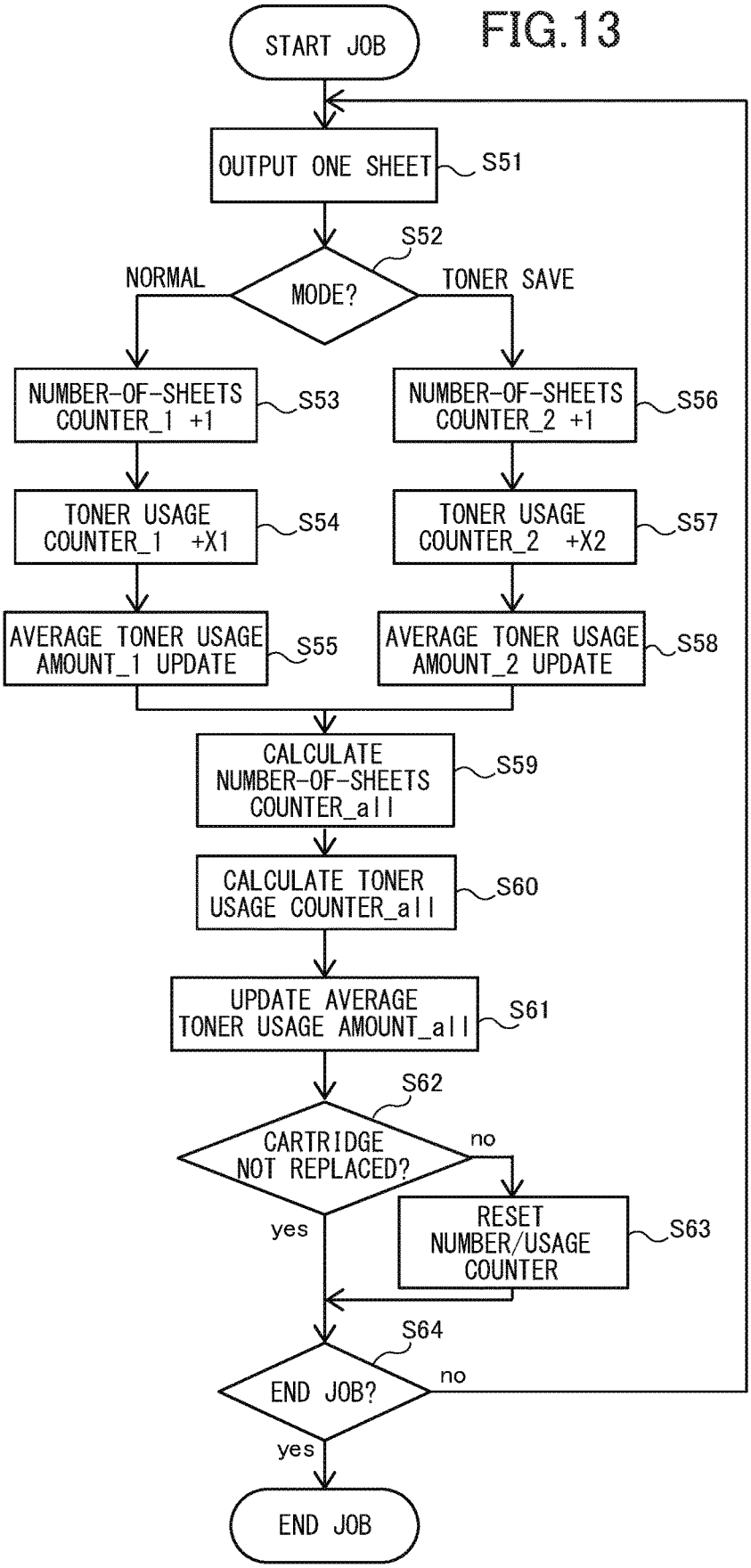
FIG. 13 is a flowchart in calculating an average toner usage amount in the normal mode and in a toner save mode of a third embodiment.

A third embodiment of the present disclosure will be described by using FIGS. 13 and 14 and while making reference to FIGS. 1, 2 and 4. The case where the second image forming mode is the concentration-up mode has been described in the abovementioned first and second embodiments. Meanwhile, a case where the second image forming mode is a toner save mode will be described in the present embodiment. Because other configurations and operations are the same as those of the first and second embodiments, parts different from the first and second embodiments will be mainly described below while denoting same components with same reference signs and by omitting or simplifying their illustrations and descriptions.

The toner save mode serving as the second image forming mode is a mode of suppressing a toner consumption as compared to the normal mode serving as the first image forming mode. That is, the toner save mode is a mode by which the consumption of the developer, i.e., toner, is reduced in forming an identical image with that formed in the normal mode. In other words, it is possible to form a toner image whose maximum loading amount is different from a loading amount in the normal mode.

Such toner save mode is a mode of increasing the number of sheets that can be used in the developing units 4Y through 4K by suppressing consumption of the toner 41. A typical method for realizing such mode includes a method of applying a gain in a direction of homogeneously, e.g., 50%, thinning concentration to an inputted image and a method of thinning out predetermined pixel, e.g., one pixel per every two pixels.

Suppose a user who properly uses the toner save mode for interoffice documents (5% of average area rate) normally often used the normal mode in which the toner 41 is normally used for presentation materials for customers of the user for example in the present embodiment. Calculation of average toner usage amount_1 and average toner usage amount_2 in the normal mode and the toner save mode are substantially the same just by changing 'concentration-up mode' of the first embodiment to the 'toner save mode'. Specifically, Steps S51 through 58 and Steps S62 through 64 in FIG. 13 are the same as Steps S1 through S8 and Steps S9 through 11 in FIG. 8.

Here, the toner save mode of the present embodiment is designed to cut a toner usage amount by almost 50% from that in the normal mode. As illustrated in a cartridge status screen in FIG. 14, because a remaining toner amount is 20%, it is possible to use 6,000 sheets in the normal mode. Meanwhile, although it is possible to use 12,000 sheets if the toner save mode is used and images have less area rate as they are, an average area rate is 8% because many photographs are used in the presentation documents. Therefore, by considering such use history of the user, the number of usable sheets is 7,500 sheets (=12,000×(5%÷8%) in the toner save mode.

Note what indicated as 'Mixed' is a predicted number of usable sheets in a case where the normal mode and the toner save mode are viewed in macro. The CPU 51 calculates the number of usable sheets in the 'Mixed' in Steps S59 through S61 in FIG. 13. Firstly, the CPU 51 calculates number-of-sheets counter_all in Step S59 by Equation 9, as follows:

$$\text{number-of-sheets counter_all} = \text{number-of-sheets counter_1} + \text{number-of-sheets counter_2} \quad \text{Eq. 9}$$

Next, the CPU 51 calculates toner usage counter_all in Step S60 by Equation 10, as follows:

$$\text{toner usage counter_all} = \text{toner usage counter_1} + \text{toner usage counter_2} \quad \text{Eq. 10}$$

That is, the number-of-sheets counter_all is a total of numbers of sheets outputted in all of the modes. Still further, the toner usage counter_all is a total of toner amounts used in all of the modes. Then, the CPU 51 calculates average toner usage amount_all in Step S61 by Equation 11, as follows:

$$\text{average toner usage amount_all} = \text{toner usage counter_all} \div \text{number-of-sheets counter_all} \quad \text{Eq. 11}$$

Then, the CPU 51 calculates and displays a mixed number of usable sheets on the UI 53 similarly to Equation 2 of the first embodiment. As illustrated in FIG. 14, the number of usable sheets of the recording material of the cartridge in the normal mode and the number of usable sheets of the recording material of the cartridge in the toner save mode are displayed on the same screen in the present embodiment. Still further, the number of usable sheets of the recording material of the cartridge in the mixed mode is also displayed on the same screen.

In a case of the present embodiment as described above, the user can grasp at a glance how many sheets can be used further in which mode by displaying the numbers of usable sheets in the normal mode and the toner save mode on the same screen. For instance, in a case where the user does not wish to replace the cartridge during a job, it is obvious for the user whether the toner 41 is sufficient in a mode to be used from now on. Meanwhile, in a case where there is plenty of remaining toner, the user may wish to know roughly a cartridge replacing timing. In such a case, the user can grasp the timing by watching the display of the mixed use.

Note that it is possible to arrange so as to display the number of usable days of the cartridge respectively in the normal mode and the toner save mode also in the present embodiment similarly to the first embodiment described above. In this case, the number of usable sheets and the number of usable days may be displayed on the same screen or may be displayed switchably. Still further, only either one of the number of usable sheets and the number of usable days may be displayed in the same manner as with the first embodiment. It is also possible to display by considering the life of the developing roller similarly to the second embodiment.

Other Embodiments

The configuration in which one-component developer containing nonmagnetic toner is used as the developer has been described in the respective embodiments described above. However, the developer may be one-component developer containing magnetic toner. Note that the one-component developer contains nonmagnetic or magnetic toner and external additive and does not contain carrier in two-component developer.

While the screens displaying the number of usable sheets and the number of usable days of the cartridge have been changed over depending on the modes in the first and second embodiments described above, it is possible to display each mode on the same screen similarly to the third embodiment. That is, the number of usable sheets or the number of usable days of the recording material of the cartridge in the normal mode and in the concentration-up mode or the number of usable sheets and the number of usable days of the recording material may be displayed simultaneously. Still further, at least one of the number of usable sheets and the number of usable days in the mixed mode of the normal mode and the concentration-up mode may be displayed also in the first and second embodiments similarly to the third embodiment. Still further, the display screen may be changed over in the normal mode and in the toner save mode in the third embodiment similarly to the first and second embodiments.

Still further, the toner save mode described in the third embodiment may be executed in addition to the normal mode and the concentration-up mode described in the first and second embodiments. In this case, at least one of the number of usable sheets and the number of usable days in each of the modes is displayed. Their display may be made by changing over in each mode or may be made on the same screen. Still further, a display in a case where these three modes are mixed may be made in the same manner as with the third embodiment.

Still further, the concentration-up mode and the toner save mode may be configured by modes in a plurality of stages in which a toner consumption amount on a same image is different. For instance, the concentration-up mode may include a first concentration-up mode and a second concentration-up mode in which a toner consumption amount in a same image is larger than that in the first concentration-up mode. Or, the toner save mode may include a first toner save mode and a second toner save mode in which a toner consumption amount in forming a same image is smaller than that in the first toner save mode. At least one the number of usable sheets and the number of usable days is displayed for each mode also in a case where there is a plurality of modes as described above. They may be changed over by the modes or may be displayed on a same screen also in this case. Still further, in a case where the screens are changed over and in a case where the concentration-up mode or the toner save mode is composed of a plurality of modes, respectively, the concentration-up mode or the toner save mode may be displayed while displaying each of their plurality of modes on a same screen.

Still further, either one of the number of usable sheets and the number of usable days may be transmitted to an external device similarly to the case described in the first embodiment also in the second and third embodiments and in the configuration having a plurality of modes such as the three modes described above.

Still further, while the configuration in which the developing cartridge is the developing unit has been described in the respective embodiments described above, a cartridge configured to display or to transmit at least one of the number of usable sheets and the number of usable days is not confined to that.

Figure 15:
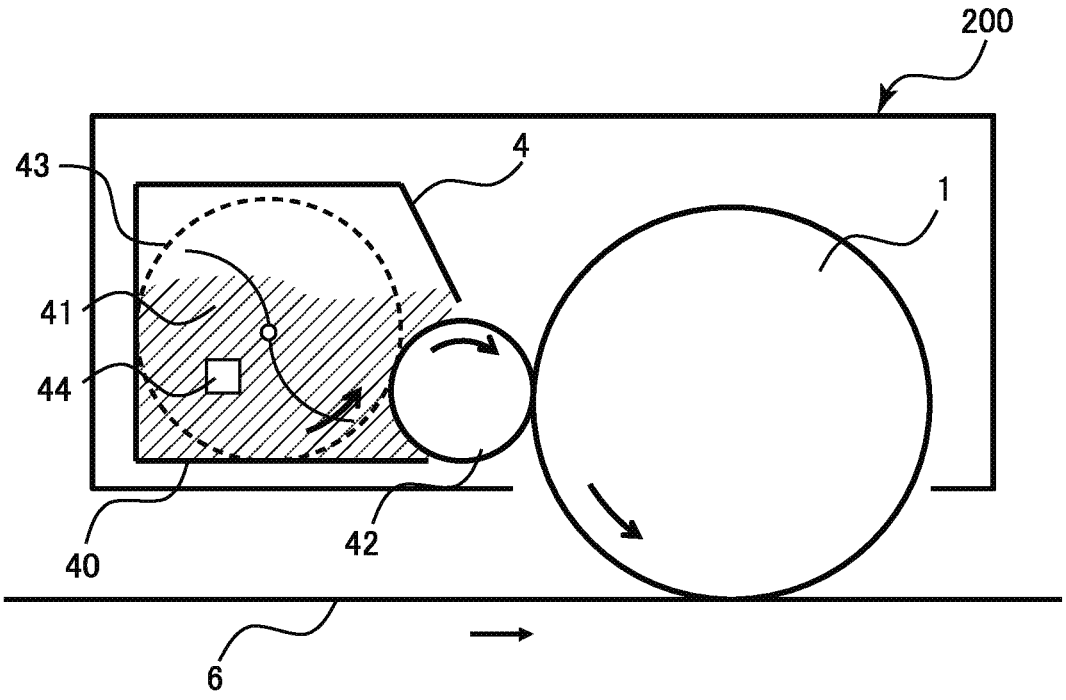
FIG. 15 schematically illustrates a configuration of a part of an image forming station according to a first example of another embodiment.

For instance, as illustrated in FIG. 15, a process cartridge 200 including the photosensitive drum 1 serving as the image bearing member and the developing unit 4 may be a developing cartridge removably attached to the apparatus body. The developing unit 4 is the same as the developing units 4Y through 4K described above. Still further, although the photosensitive drum 1 is the same as the photosensitive drums 1Y through 1K described above, the process cartridge 200 may include a charging roller and a cleaning unit.

In this case, the number of usable sheets and the number of usable days of the process cartridge in each mode are displayed or transmitted in the same manner as with the first through third embodiments described above and the configuration having the plurality of modes such as the three modes described above. Still further, it is possible to arrange so as to count the number of times of rotation of the photosensitive drum 1 and to display or to transmit it by considering a life the photosensitive drum in the same manner as with the second embodiment. Or, it is possible to arrange so as to count a period of service of the cleaning unit, e.g., the number of times of rotation of the photosensitive drum 1, and to display or to transmit it by considering a life the cleaning unit.

Figure 16:
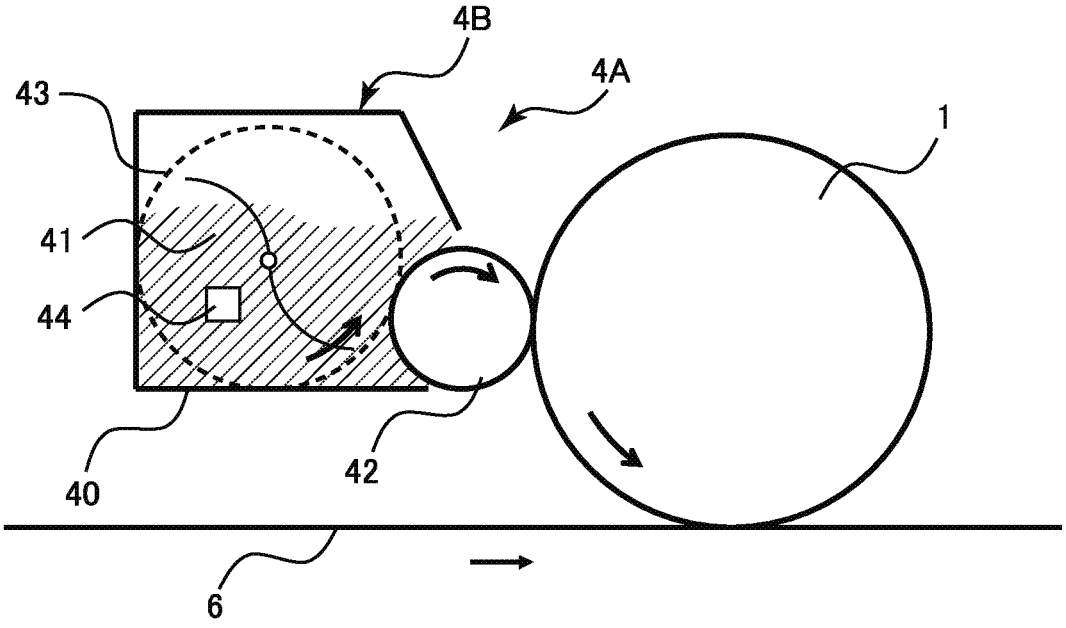
FIG. 16 schematically illustrates a configuration of a part of an image forming station according to a second example of the other embodiment.

Still further, as illustrated in FIG. 16, there is a configuration of the developing unit 4A in which the developing roller 42 is separable from the developer supplying unit 4B and in which only the developer supplying unit 4B is formed to be a cartridge removably attached to the apparatus body. The developer supplying unit 4B includes the storage container 40 and the supply member 43. At least one of the number of usable sheets and the number of usable days of the developer supplying unit 4B may be displayed in the same manner as with the first through third embodiments and with the configuration having the plurality of modes such as the three modes described above.

Still further, the calculations of the number of usable sheets and the number of usable days of the cartridge have been made by the CPU 51 (see FIG. 4) of the image forming apparatus in the respective embodiments described above. However, these calculations may be performed by the PC 52 serving as a computer. This configuration will be described with reference to FIG. 4. Firstly, the PC 52 is communicably connected with the image forming apparatus 100. Then, the printer driver 56 serving as a program is installed in the PC 52. The printer driver 56 can obtain information such as the number of output sheets and a toner usage amount per mode and causes the PC 52 to execute a next step.

The printer driver 56 causes the PC 52 to calculate at least the number of usable sheets and the number of usable days of the recording material of the cartridge corresponding respectively to the first and second modes from the obtained information as a first step. Then, the printer driver 56 displays a result calculated in the first step on a display portion such as a display connected to the PC 52 as a second step. Even if the image forming apparatus does not have the function of calculating the number of usable sheets and the number of usable days in each mode, it is possible to cause the computer to perform such function by installing such program in the computer.

The image forming apparatus may be any one of a copier, a printer, a facsimile machine and a multi-function printer having a plurality of such functions.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-107293, filed Jun. 7, 2019, which is hereby incorporated by reference herein in its entirety.

What is claimed is:

1. An image forming apparatus configured to form a toner image on a recording material, comprising:

an image forming unit including an image bearing member and a developing cartridge configured to store developer and having a developer bearing member configured to bear and convey the developer stored in the developing cartridge toward a position where an electrostatic latent image formed on the image bearing member is developed;

a control portion configured to cause the image forming unit to form the toner image in one mode selected from a plurality of modes including a first image forming mode for forming a first toner image whose maximum loading amount is a first loading amount and a second image forming mode for forming a second toner image whose maximum loading amount is a second loading amount different from the first loading amount;

a detection unit configured to detect a developer amount within the developing cartridge; and a display portion configured to display information related to the number of sheets of a recording material on which the first toner images can be formed in the first image forming mode in a case where the developer amount within the developing cartridge detected by the detection unit reaches a predetermined amount and information related to the number of sheets of a recording material on which the second toner images can be formed in the second image forming mode in the case where the developer amount within the developing cartridge detected by the detection unit reaches the predetermined amount.

2. The image forming apparatus according to claim 1, wherein the display portion is configured to simultaneously display the information related to the number of sheets of the recording material on which the first toner images can be formed in the first image forming mode in the case where the developer amount within the developing cartridge detected by the detection unit reaches the predetermined amount and the information related to the number of sheets of the recording material on which the second toner images can be formed in the second image forming mode in the case where the developer amount within the developing cartridge detected by the detection unit reaches the predetermined amount.

3. The image forming apparatus according to claim 1, wherein the display portion is configured to display information related to the number of days during which the first toner images can be formed in the first image forming mode by using the developing cartridge in the case where the developer amount within the developing cartridge detected by the detection unit reaches the predetermined amount and information related to the number of days during which the second toner images can be formed in the second image forming mode by using the developing cartridge in the case where the developer amount within the developing cartridge detected by the detection unit reaches the predetermined amount.

4. The image forming apparatus according to claim 3, wherein the display portion is configured to simultaneously display the information related to the number of sheets of the recording material on which the first toner images can be formed in the first image forming mode in the case where the developer amount within the developing cartridge detected by the detection unit reaches the predetermined amount and the information related to the number of days during which the first toner images can be formed in the first image forming mode by using the developing cartridge in the case where the developer amount within the developing cartridge detected by the detection unit reaches the predetermined amount.

5. The image forming apparatus according to claim 3, wherein the display portion is configured to simultaneously display the information related to the number of sheets of the recording material on which the second toner images can be formed in the second image forming mode in the case where the developer amount within the developing cartridge detected by the detection unit reaches the predetermined amount and the information related to the number of days during which the second toner images can be formed in the second image forming mode by using the developing cartridge in the case where the developer amount within the developing cartridge detected by the detection unit reaches the predetermined amount.

6. The image forming apparatus according to claim 1, wherein the image bearing member and the developer bearing member are rotatable, and wherein a rate of a rotational speed of the developer bearing member to a rotational speed of the image bearing member in forming the second toner images in the second image forming mode is different from a rate of a rotational speed of the developer bearing member to a rotational speed of the image bearing member in forming the first toner images in the first image forming mode.

7. The image forming apparatus according to claim 6, wherein the rotational speed of the developer bearing member in forming the second toner images in the second image forming mode is equal to the rotational speed of the developer bearing member in forming the first toner images in the first image forming mode, and wherein the rotational speed of the image bearing member in forming the second toner images in the second image forming mode is different from the rotational speed of the image bearing member in forming the first toner images in the first image forming mode.

8. The image forming apparatus according to claim 6, wherein the rotational speed of the image bearing member in forming the second toner images in the second image forming mode is equal to the rotational speed of the image bearing member in forming the first toner images in the first image forming mode, and wherein the rotational speed of the developer bearing member in forming the second toner images in the second image forming mode is different from the rotational speed of the developer bearing member in forming the first toner images in the first image forming mode.

9. An image forming apparatus configured to form a toner image on a recording material, comprising:

an image forming unit including an image bearing member and a developing cartridge configured to store developer and having a developer bearing member configured to bear and convey the developer stored in the developing cartridge toward a position where an electrostatic latent image formed on the image bearing member is developed;

a control portion is configured to cause the image forming unit to form the toner images in one mode selected from a plurality of modes including a first image forming mode for forming a first toner image whose maximum loading amount is a first loading amount and a second image forming mode for forming a second toner image whose maximum loading amount is a second loading amount different from the first loading amount;

a detection unit configured to detect a developer amount within the developing cartridge; and a display portion configured to display information related to the number of days during which the first toner images can be formed in the first image forming mode by using the developing cartridge in a case where the developer amount within the developing cartridge detected by the detection unit reaches a predetermined amount and information related to the number of days during which the second toner images can be formed in the second image forming mode by using the developing cartridge in the case where the developer amount within the developing cartridge detected by the detection unit reaches the predetermined amount.

10. The image forming apparatus according to claim 9, wherein the display portion is configured to simultaneously display information related to the number of days during which the first toner images can be formed in the first image forming mode by using the developing cartridge in the case where the developer amount within the developing cartridge detected by the detection unit reaches a predetermined amount and information related to the number of days during which the second toner images can be formed in the second image forming mode by using the developing cartridge in the case where the developer amount within the developing cartridge detected by the detection unit reaches the predetermined amount.

11. The image forming apparatus according to claim 9, wherein the image bearing member and the developer bearing member are rotatable, and wherein a rate of a rotational speed of the developer bearing member to a rotational speed of the image bearing member in forming the second toner images in the second image forming mode is different from a rate of a rotational speed of the developer bearing member to a rotational speed of the image bearing member in forming the first toner images in the first image forming mode.

12. The image forming apparatus according to claim 11, wherein the rotational speed of the developer bearing member in forming the second toner images in the second image forming mode is equal to the rotational speed of the developer bearing member in forming the first toner images in the first image forming mode, and wherein the rotational speed of the image bearing member in forming the second toner images in the second image forming mode is different from the rotational speed of the image bearing member in forming the first toner images in the first image forming mode.

13. The image forming apparatus according to claim 11, wherein the rotational speed of the image bearing member in forming the second toner images in the second image forming mode is equal to the rotational speed of the image bearing member in forming the first toner images in the first image forming mode, and wherein the rotational speed of the developer bearing member in forming the second toner images in the second image forming mode is different from the rotational speed of the developer bearing member in forming the first toner images in the first image forming mode.

14. An image forming apparatus configured to communicate with an external device and to form a toner image on a recording material, comprising:

an image forming unit including an image bearing member and a developing cartridge configured to store developer and having a developer bearing member configured to bear and convey the developer stored in the developing cartridge toward a position where an electrostatic latent image formed on the image bearing member is developed;

a control portion configured to cause the image forming unit to form the toner image in one mode selected from a plurality of modes including a first image forming mode for forming a first toner image whose maximum loading amount is a first loading amount and a second image forming mode for forming a second toner image whose maximum loading amount is a second loading amount different from the first loading amount;

a detection unit configured to detect a developer amount within the developing cartridge; and a transmission portion configured to transmit information related to the number of sheets of a recording material on which the first toner images can be formed in the first image forming mode in a case where the developer amount within the developing cartridge detected by the detection unit reaches a predetermined amount and information related to the number of sheets of a recording material on which the second toner images can be formed in the second image forming mode in the case where the developer amount within the developing cartridge detected by the detection unit reaches the predetermined amount, respectively, to the external device.

15. The image forming apparatus according to claim 14, wherein the transmission portion is configured to further transmit information related to the number of days during which the first toner images can be formed in the first image forming mode by using the developing cartridge in the case where the developer amount within the developing cartridge detected by the detection unit reaches the predetermined amount and information related to the number of days during which the second toner images can be formed in the second image forming mode by using the developing cartridge in the case where a developer amount within the developing cartridge detected by the detection unit reaches the predetermined amount, respectively, to the external device.

16. An image forming apparatus configured to communicate with an external device and to form a toner image on a recording material, comprising:

an image forming unit including an image bearing member and a developing cartridge configured to store developer and having a developer bearing member configured to bear and convey the developer stored in the developing cartridge toward a position where an electrostatic latent image formed on the image bearing member is developed;

a control portion configured to cause the image forming unit to form the toner image in one mode selected from a plurality of modes including a first image forming mode for forming a first toner image whose maximum loading amount is a first loading amount and a second image forming mode for forming a second toner image whose maximum loading amount is a second loading amount different from the first loading amount;

a detection unit configured to detect a developer amount within the developing cartridge; and a transmission portion configured to transmit information related to the number of days during which the first toner images can be formed in the first image forming mode in a case where the developer amount within the developing cartridge detected by the detection unit reaches a predetermined amount and information related to the number of days during which the second toner images can be formed in the second image forming mode in the case where the developer amount within the developing cartridge detected by the detection unit reaches the predetermined amount, respectively, to the external device.

* * * * *